US006302997B1

(12) United States Patent
Hurter et al.

(10) Patent No.: US 6,302,997 B1
(45) Date of Patent: Oct. 16, 2001

(54) PROCESS FOR PRODUCING A PULP SUITABLE FOR PAPERMAKING FROM NONWOOD FIBROUS MATERIALS

(75) Inventors: Robert W. Hurter, Orleans (CA); Medwick V. Byrd, Jr., Raleigh, NC (US)

(73) Assignees: North Carolina State University, Raleigh, NC (US); HurterConsult Incorporated, Gloucester (CA)

( * ) Notice: Subject to any disclaimer, the term of this patent is extended or adjusted under 35 U.S.C. 154(b) by 0 days.

(21) Appl. No.: 09/385,154

(22) Filed: Aug. 30, 1999

(51) Int. Cl.[7] ..... D21C 9/147; D21C 9/153

(52) U.S. Cl. ..... 162/65; 162/90; 162/91; 162/96; 162/97; 162/98; 162/99

(58) Field of Search ..... 162/65, 78, 99, 162/80, 90, 91, 96, 97, 98, 94, 95

(56) References Cited

U.S. PATENT DOCUMENTS

| | | | | |
|---|---|---|---|---|
| 4,016,029 | * | 4/1977 | Samuelson | 162/31 |
| 4,649,113 | | 3/1987 | Gould . | |
| 4,652,341 | | 3/1987 | Prior . | |
| 4,756,799 | | 7/1988 | Bengtsson et al. . | |
| 4,774,098 | | 9/1988 | Gould et al. . | |
| 4,806,475 | | 2/1989 | Gould . | |
| 4,900,399 | | 2/1990 | Bengtsson et al. . | |
| 4,973,559 | | 11/1990 | Dexter et al. . | |
| 4,997,488 | | 3/1991 | Gould et al. . | |
| 5,002,635 | | 3/1991 | Gentile, Jr. et al. . | |
| 5,034,096 | * | 7/1991 | Hammer et al. | 162/65 |
| 5,607,546 | | 3/1997 | Hoglund et al. . | |
| 5,770,010 | | 6/1998 | Jelks . | |

FOREIGN PATENT DOCUMENTS

| | | | |
|---|---|---|---|
| 55051890 | * | 4/1980 | (JP) . |
| WO99/41448 | | 8/1999 | (WO) . |

OTHER PUBLICATIONS

Atchison, J. E., Chapter IV. Pulp and Paper Manufacture 3rd Edition (1987), vol. 3 Secondary Fibers and Non–Wood Pulping pp. 22–66 (section G. Depithing, pp. 30–39), published by the Joint Textbook Committee of the Paper Industry (TAPPI and CPPA).

* cited by examiner

*Primary Examiner*—Dean T. Nguyen
(74) *Attorney, Agent, or Firm*—Jenkins & Wilson, P.A.

(57) ABSTRACT

A process for producing a pulp suitable for papermaking from a nonwood fiber source material. Representative nonwood fiber source materials include corn stover and wheat straw. The process includes the steps of providing a nonwood fiber source material; digesting the nonwood fiber source material with an alkaline pulping solution at at least about atmospheric pressure; reducing the pH of the nonwood fiber source material to an acidic pH with an acid solution; treating the nonwood fiber source material having an acidic pH with ozone; and treating the nonwood fiber source material with a bleaching solution to form a papermaking pulp.

64 Claims, 6 Drawing Sheets

PROCESS FOR PRODUCING A PULP SUITABLE FOR PAPERMAKING FROM NONWOOD FIBROUS MATERIALS

TECHNICAL FIELD

The present invention relates generally to a pulping process for nonwood materials. More particularly, this invention relates to a simple and environmentally benign process for pulping of corn stover and other nonwood fiber source materials to produce a high-quality papermaking pulp.

BACKGROUND ART

It will appreciated by one having ordinary skill in the art that trees and other woody plants are not the only source of fibers for papermaking. There are a variety of nonwood annual and perennial plants which produce fibers having sufficient strength and length to produce paper with acceptable qualities. These nonwood plants are often referred to in the art as "agricultural residues" or "fiber crops". Examples of plants for each of these categories include:

| Agricultural Residues | Fiber Crops |
|---|---|
| Wheat straw | Kenaf |
| Rice straw | Industrial hemp |
| Corn stalks | Sisal |
| Bagasse (sugar cane) | Textile flax straw |
| Rye grass straw | Hesperaloe |
| Seed flax straw | |
| Flax straw | |

One of the main advantages of these fiber sources is that they are perceived in the art as environmentally-benign alternatives to the use of trees. Indeed, nonwoods are currently the major source of papermaking fiber for some developing countries and countries lacking significant wood resources.

For the most part, however, the development of a nonwood fiber industry in North America has been retarded due to the fact that nonwood pulps are usually more expensive on a per-ton basis than wood pulps. Recently, several factors have dramatically increased the level of industry interest in these nonwood fiber sources. Some of these factors include environmental pressure to stop using trees; projections of world fiber shortage by 2010 and the need to find alternative fiber sources; abundance of agricultural residues (such as corn stover and wheat straw) that are otherwise burned off fields; and opportunities to produce multiple products (oils, textile fibers, papermaking fibers, board fibers, plastics, food) from a simple fiber source, which provides unique opportunities for sustainable agriculture.

However, effective use of nonwood fiber sources presents some significant challenges that must be overcome. These challenges include the following:

(1) nonwoods must be harvested annually and stored, and thus, are sensitive to growing season, harvest conditions, etc.;

(2) nonwoods have a low bulk density compared to trees, and thus, can be hard to store and transport;

(3) nonwoods may require larger amounts of herbicides and pesticides as compared to trees;

(4) nonwoods generally require smaller pulp and paper mills due to transport constraints, and it is often difficult to establish efficient chemical recovery systems for small mills; and (5) many, but not all, nonwoods comprise fibers that may be shorter, more slender, or weaker than wood fibers.

Agricultural residues represent an economically-promising source of nonwood fibers. The low bulk density and high transport costs of agricultural residues suggests a nonwood mill capable of producing 50–350 tons of pulp per day. This "mini-mill" must produce pulp which can compete with wood pulp produced in very efficient "mega-mills" producing 1000–3000 tons per day. To make the situation even more challenging, it is generally not possible to simply scale down the wood pulp processes, which rely on large production volumes to justify the high capital costs of equipment.

In order to be successful, nonwood mini-mills must therefore make use of processes which are cost effective and environmentally sound at small scale. Such processes should ideally meet the following criteria:

(1) The process should have a minimal number of processing steps, or stages;

(2) The process should utilize a minimal amount of equipment;

(3) The equipment should be as simple and low-cost as possible;

(4) The process should minimize water usage by:

(a) recycling as many filtrate streams internally as possible, (b) minimizing the number of dilution and thickening stages required, (c) minimizing the number of washing stages required, and (d) minimizing the number of pH changes required;

(5) The process should use readily-available chemicals at reasonable dosage levels;

(6) The process should be odor-free and optionally, chlorine-free; and (7) The process should use chemicals which permit recovery of all internal filtrate streams.

Given the fragile nature of agricultural residues and the quality requirements of the printing and writing grade paper markets, the successful mini-mill process should also meet the following criteria:

(1) The final pulp should have a brightness in the 70–90% ISO range for paper grades made in an integrated pulp and paper mill, and 85–90% ISO for high-end and market pulp grades;

(2) The pulp should have adequate strength properties, i.e. the fibers should be subjected to minimum damage;

(3) The drainage rate (freeness) of the pulp should be sufficiently high so that the pulp can be formed and dewatered on a typical paper machine; and (4) The process should be able to remove the high content of pith, parenchymal cells, fines, and other non-fibrous materials often found in nonwoods; these materials make the pulp "dirty" and also cause slow drainage.

Thus, a substantial challenge in reducing nonwood raw materials into fibers for papermaking is to find a pulping method for application in a mini-mill setting which addresses the criteria set forth above. The term "pulping" is generally defined as the reduction of the bulk fiber source material into its component fibers. The key is to perform this reduction without damaging the fiber (thereby reducing strength) or without losing too much fiber that will be suitable for papermaking (termed a "yield loss").

Several classes of pulping processes are generally known in the art. These processes include the following:

(1) Chemical Pulping—In this type of pulping, a large chemical dose is used to dissolve away most of the lignin (glue) which holds the fibers together in the raw material. This dissolution is carried out in a digester, where chemicals are mixed with the raw material and then heated to medium to high temperature (100–170° C.) and high pressure (2–15 atm). Standard digestion processes are carried out for about 1–8 hours. At the end of the digestion, the fibers are washed to separate them from the liquor, which contains dissolved lignin and spent chemicals. Elaborate systems have been developed to thicken and burn the liquor in order to recover heat energy from the lignin and regenerate the chemicals for use in subsequent digestion procedures.

Pulps from full chemical processes are characterized by high purity (high cellulose content, low hemicellulose and lignin content), suitable cleanliness levels, and suitable strength. With subsequent bleaching, high-brightness pulps for demanding printing and writing grade paper products may be produced. However, the processes often have a low yield (30–50%) due to chemical dissolution. In addition, full chemical processes require high capital investment and high operating costs. Thus, standard full chemical pulping processes are generally not suitable for nonwoods pulping applications in mini-mills.

(2) Mechanical Pulping—In this type of pulping, raw materials are separated into fibers using brute mechanical force. Usually, the raw material is placed between rotating refiner plates, which shear it apart. Heat can be applied to soften the fibers prior to refining. Yield from these types of processes is typically high (65–95%), but the quality of pulps is usually inferior to chemical pulps. Because there is still a large amount of lignin on the fiber surfaces, bonding sites are blocked, resulting in lower strength properties. Sheet flexibility is also reduced because lignin is left in the fiber walls. Overall, mechanical pulps are useful only for low-end paper grades like newsprint or catalog. However, since large quantities of chemicals are not required, chemical recovery is no problem. In addition, capital and operating costs are manageable. However, because of the limitation on pulp, and subsequently paper, quality described above, a purely mechanical process is also believed to have limited application to the pulping of nonwoods due to the fragile nature of many nonwoods.

(3) Chemi-Mechanical Pulping—This type of pulping uses aspects of both of the previously described process types. Raw material is impregnated with small amounts of chemicals to soften the lignin, and then it is mechanically treated to complete the separation. Heat is typically applied to improve pulping. With this hybrid process, good fiber properties may be developed without extensive chemical application. In addition, capital and operating costs are almost as low as for pure mechanical pulping. Pulps from chemi-mechanical processes can be used for low- to medium-quality papers, and with additional processing they may be used for some high-end purposes. However, a chemi-mechanical pulping process suitable for the pulping of nonwoods has not been described in the art.

Background art patents include U.S. Pat. Nos. 4,756,799 and 4,900,399, both to Bengtsson et al., describing methods for manufacturing bleached chemi-mechanical and semi-mechanical fiber pulp by means of a one or two stage impregnation process. However, these patents particularly describe production of a pulp from wood materials. The described methods particularly require that the wood material be preheated before it is subjected to mechanical manipulation in a standard twin disk refiner. Thus, the method steps described in these U.S. patents are not believed to have particular application to a pulping process for nonwood m materials.

U.S. Pat. Nos. 4,997,488 to Gould et al.; 4,806,475 to Gould; U.S. Pat. No. 4,774,098 to Gould et al.; and, 4,649,113 to Gould describe alkaline peroxide treatment of nonwoody lignocellulosics and products made by such treatments. However, the primary focus of these patents is the production of nutritional supplements, culture media or other compounds from cellulose in the nonwoody materials for use in feeding domestic animals, humans, or in the growth of microbial cultures. Stated differently, the focus of the methods described in these patents is to produce materials from cellulose that can be metabolized by animals.

Despite the disclosure of the foregoing U.S. patents, there has been no suggestion in the art of a pulping process for nonwood fiber source materials that meets the criteria set forth above. Indeed, for nonwoods the most sensible approach is to install a small mill at the center of a defined growing area. As noted above, this mill should use a simple process, with low operating and capital costs, to maintain economies of scale equal to those of the mega-mill. The process should render the mill almost invisible to the environment, and should require only small amounts of environmentally-benign chemical agents. Such a process is not currently available in the art.

SUMMARY OF THE INVENTION

A process for producing a pulp suitable for use in papermaking from a nonwood fiber source material has been developed by the applicants and is disclosed herein. The process comprises providing a nonwood fiber source material; digesting the nonwood fiber source material with an alkaline pulping solution at at least about atmospheric pressure; reducing the pH of the nonwood fiber source material to an acidic pH with an acid solution; treating the nonwood fiber source material having an acidic pH with ozone; and treating the nonwood fiber source material with a bleaching solution to form a papermaking pulp.

Accordingly, it is an object of this invention to provide a nonwoods pulping process that is cost effective and environmentally sound at small scale.

It is an object of the present invention to provide a nonwoods pulping process which keeps the number of processing steps, or stages, to a minimum.

It is another object of this invention to provide a nonwoods pulping process that uses readily available, inexpensive and minimal amounts of equipment.

It is still another object of this invention to provide a nonwoods pulping process that minimizes water usage by recycling as many filtrate streams internally as possible; by minimizing the number of dilution and thickening stages required; by minimizing the number of washing stages required; and by minimizing the number of pH changes required.

It is yet another object of this invention to provide a nonwoods pulping process that uses readily available and inexpensive chemicals at moderate dosage levels and that uses chemicals which permit recovery of all internal filtrate streams.

It is a further object of this invention to provide an odor-free and optionally chlorine-free nonwoods pulping process.

It is still a further object of this invention to provide a nonwoods pulp with high freeness, desirable brightness characteristics and adequate strength properties.

It is yet a further object of this invention to provide a nonwoods pulping process that removes the high content of pith, parenchymal cells, fines, and other non-fibrous materials often found in nonwoods.

Some of the objects of the invention having been stated hereinabove, other objects will become evident as the description proceeds, when taken in connection with the accompanying Examples and Drawings as best described hereinbelow.

DETAILED DESCRIPTION OF THE INVENTION

Figure 1:
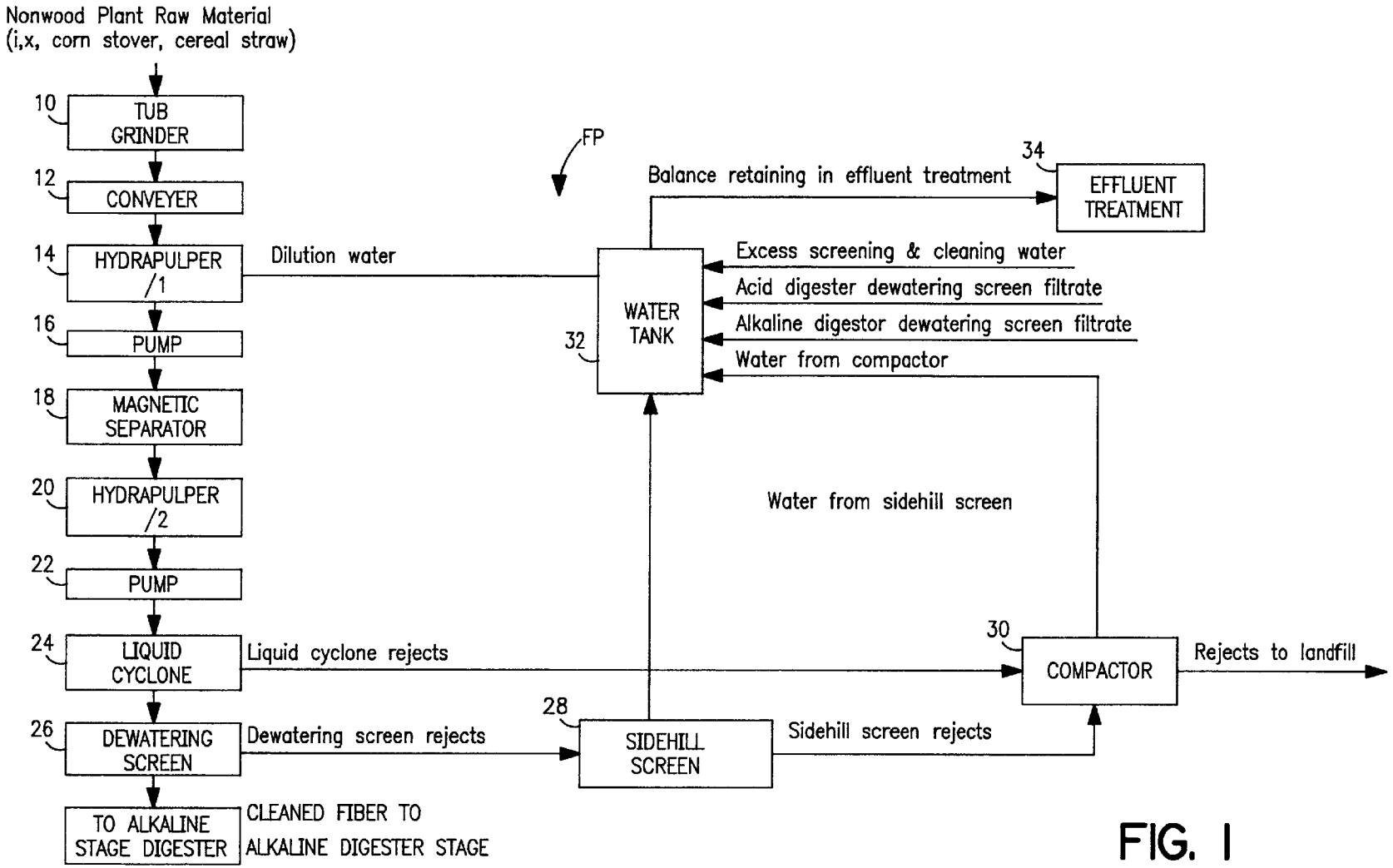
FIG. 1 is a schematic representation of an optional fiber preparation stage FP of the process of the present invention.

The novel process of the instant invention addresses the paper industry's need for a mini-mill process for use with nonwood fibers. This process is a primarily a chemical process, using a sequence of chemical treatment steps to produce high-quality pulps.

The term "woody" is used herein both in the botanical sense to mean "comprising wood"; that is, composed of extensive xylem tissue as found in trees and shrubs, and also in the sense of being "wood-like". Accordingly, the terms "nonwood", "nonwoods", and "nonwoody" refer to materials lacking these characteristics.

An excellent candidate for a source of nonwood fiber material is corn stover (stalks, leaves and husks). Other candidate agricultural residues and fiber crops include, but are not limited to, kenaf, industrial hemp, wheat straw, rice straw, bagasse (sugar cane), seed flax straw, textile flax straw, sisal, hesperaloe and rye grass.

The term "consistency", as used herein in referring to "reaction consistency" and to "pulp consistency", denotes percent (%) solids of the pulp slurry.

The term "freeness", as used herein refer to "pulp freeness", refers to the drainage rate of pulp, or how "freely" the pulp will give up its water. Freeness is important in papermaking in that, if the freeness is too low, it is not possible to remove enough water on the paper machine to achieve good sheet structure and strength. Often, mechanical pulps have low freeness due to harsh action imparted to the raw material, which produces fines and particles which plug up the draining paper mat. Many chemical pulping processes using whole-stalk (both bast and core) nonwood fiber sources materials have problems with poor freeness, due to over-pulping of the core fraction.

The process of the instant invention does not suffer from the freeness problems of prior art processes. Indeed, the process of the instant invention produces a pulp with high freeness. Particularly, for the instant process, pulp freeness is at least about 400 mL CSF. Preferably, pulp freeness is at least about 550 mL CSF, and more preferably, ranges from approximately 550–650 mL CSF. Accordingly, as used herein, the term "high freeness" is meant to refer to a freeness of at least about 400 mL CSF and above.

Many methods of measuring the degree of delignification have been developed in the art, but most are variations of the permanganate test. The normal permanganate test provides a permanganate or "K number" or "Kappa number", which is the number of cubic centimeters of tenth normal (0.1N) potassium permanganate solution consumed by one gram of oven dried pulp under specified conditions. It is determined by TAPPI Standard Test T-214. The acceptable Kappa number range will vary depending upon the intended use of the pulp (e.g., the Kappa number requirements for brown paperboard may vary from about 50 to about 90 while the requirements for white paper stock may be less than 5).

There are also a number of methods of measuring pulp brightness. This parameter is usually a measure of reflectivity and its value is typically expressed as a percent of some scale. A standard method is GE brightness which is expressed as a percentage of a maximum GE brightness as determined by TAPPI Standard Method TPD-103. The International Standards Organization (ISO) brightness test is also used. Final pulps produced by the process of the present invention should have a brightness in the 70 to 90% ISO range, preferably in the 80–88% ISO range, and more preferably in the 85–88% ISO range (suitable for use in the manufacture of any printing and writing grade paper).

Therefore, the cost-effective and environmentally benign process of the present invention, via one initial stage of pulping and three subsequent stages of bleaching, converts corn stover and other agricultural residues into high-brightness papermaking pulps of good cleanliness, strength, and drainage rate. The process utilizes whole corn stover (stalks, leaves, husks) without any type of mechanical or chemical depithing and produces pulps having strength properties similar to those from selected hardwood pulps. A total process yield of about 35–40% on corn stalk is equal to or better than total yield values for harsher and more costly pulping and bleaching processes. Finally, the process of the present invention accomplishes this yield using moderate chemical charges, temperatures, and pressures.

Process Stages

To date, there has been no prior art process which makes use of the process steps in the order presented in accordance with the present invention. There are at least two notable differences between the process of the present invention and prior art processes currently attempted on nonwoods.

Firstly, the process of the present invention uses mild or moderate conditions for the pulping of the raw material. Most prior art processes use much higher chemical charges, temperatures, and pressures for pulping stage. While the present co-inventors do not wish to be bound by a particular theory of operation, it is contemplated that the harsh conditions of prior art processes actually make it more difficult to remove lignin from the raw material and may result in the re-depositing of lignin on the fibers.

Secondly, the harshness of ozone as a bleaching agent is well-documented. See e.g., U.S. Pat. No. 5,770,010 issued to Jelks on Jun. 23, 1998, herein incorporated by reference. Indeed, ozone often causes some damage to pulp fibers as it attacks lignin and color-causing molecules. For this reason, ozone has been avoided as a bleaching agent for nonwoods (especially cereal straw), since nonwood fibers are often slender and fragile. However, ozone offers both powerful delignifying and bleaching action in the same stage. Its use in the present inventive process thus facilitates the production of strong, white, and bright pulps from corn stover and other nonwood materials.

Therefore, in a preferred embodiment, the process of the present invention comprises the following steps or stages in the following order:

Mild Alkaline Extraction Stage

This stage uses mild conditions, including a moderate application of alkali, to degrade and/or solubilize a significant portion of the non-cellulosic material (e.g. lignin) in the nonwood fiber source material. Alkali is added to provide a Kappa number of the material after the stage of about 15–20 as this range permits full bleaching to 85–88% ISO brightness with a moderate charge of bleaching chemicals. If lower brightness levels are acceptable, the alkali charge may be reduced, resulting in a higher Kappa number after the alkaline extraction stage.

Thus, typically, a dosage of alkali ranging from about 10% weight to about 30% weight on oven dried fiber (ODF), and preferably from about 12% weight to about 15% weight ODF is applied in this stage. As noted above, the actual dosage will depend on the raw material lignin content and structure, on the desired final brightness level and on the desired bleaching chemical consumption levels.

The source of alkali for the first stage may vary widely, and any suitable source of alkali (sodium hydroxide, potassium hydroxide, calcium hydroxide, ammonium hydroxide, etc.) is contemplated for use in this stage. Sodium hydroxide, a widely-available and inexpensive source of alkali, may be used to produce high pulp brightness and quality. A preferred dosage range for sodium hydroxide is 12–15% weight on ODF, depending on the raw material being treated. Corn stover typically utilizes a dosage of approximately 12%, while denser, more pectinous structures such as wheat straw may require dosages of up to about 20% to about 30% weight on ODF.

Potassium hydroxide may also be used. Its use is contemplated to be an advantage in processing nonwood materials, since nonwood materials have a considerable content of potassium, and could thus serve as a source of makeup chemical for a mill practicing the process of the present invention. If the same dosage is used as is normally used for sodium hydroxide, the lignin content (as measured by the Kappa number) for the treated material will be higher, and the final pulp brightness will be lower at the same bleaching chemical dosages as is normally used after sodium hydroxide digestion. If higher final brightness is desired, the dosage of potassium hydroxide may be increased by about 30% weight on ODF or more than the dosages as are normally used for sodium hydroxide digestion, so that the Kappa number of the pulp after alkaline treatment is lowered to the same level as would be obtained from the use of sodium hydroxide. Alternatively, the amount of bleaching chemical in the ozone treatment or bleaching stages may be increased.

Mild temperature and mild pressure are employed in this stage. Stage temperatures may range from ambienttemperature to about 150° C., preferably from about 50° C. to about 140° C. and more preferably from about 80° C. to about 120° C. Stage pressures may range from about atmospheric to about 30 pounds per square inch gage (psig), from about 5 to about 25 psig, or from about 10 to about 20 psig. Typically, this stage lasts from about 1 to about 120 minutes, including the time associated with heating the nonwood fiber source material to the stage temperature. The material may be held at the stage temperature for about 1 to about 90 minutes, with about 30 to about 60 minutes being preferred.

Approximately 40–50% of the weight of the nonwood fiber source material is lost in this stage. After alkaline extraction/digestion, the nonwood fiber source material is lightly refined or otherwise mechanically worked to separate fiber bundles. After refining, the material is washed to remove chemical residue, which is typically referred to in the art as "black liquor".

Acid Treatment Stage—with or without Chelation

This stage is employed to both chemically react with residual lignin and to remove metal ions from the pulp, ions which retard subsequent bleaching. The pulp is acidified to an acidic pH to cause the metal ions to be released from the pulp. A chelating agent is optionally applied to tie up the metal ions and render them unable to affect subsequent bleaching stages. The chelating agent may be omitted if higher brightness levels are not required.

The acid or acid chelation treatment stage may be carried out at low pulp consistency in a simple standpipe or flow-through tank or at higher pulp consistency in rotating batch digesters or horizontal tube continuous digesters. The washed and defibered nonwood fiber source material from the alkaline extraction stage is treated with an acid solution to an acidic pH. Stage pH may range from about 0 to about 6, preferably from about 1 to about 5, and more preferably from about 1. 5 to about 3.

Stage temperatures may range from ambient temperature to about 90° C., preferably from about 40° C. to about 80° C. and more preferably from about 50° C. to about 70° C. Typically, this stage lasts from about 1 to about 120 minutes, including the time associated with adjusting the nonwood fiber source material to the stage temperature. The nonwood fiber source material may be held at the stage temperature for about 1 to about 90 minutes, with about 30 to about 60 minutes being preferred and about 20 to about 30 minutes being more preferred.

The source of acid for the second stage may vary widely, and any suitable acid solution is contemplated in accordance with the present invention. For example, mineral acids, such as sulfuric acid, nitric acid, or phosphoric acid, may be used to achieve final high brightness. An organic acid, such as acetic acid, may also be used to achieve final high brightness.

The use of a chelating agent (such as diethylene triamine pentaacetic acid—DTPA) at a moderate dosage in the second stage acid solution is optional. When a chelating agent is utilized, high final brightness may be achieved with a moderate consumption of bleaching agent in the last stage. When it is omitted, the final brightness will be lower, and bleaching agent consumption will be higher. The necessity of the chelating agent is a function of the level of metal ions in the process filtrate, which in turn is a function of the mill water supply, water treatment, and the amount of metals found in the raw nonwood fiber source material. If metal ion content is high, the use of a chelating agent in the acid solution is recommended so that suitable brightness levels may be achieved.

After reaction, the pulp slurry is thoroughly dewatered to a consistency greater than about 35%, but no washing is required. Indeed, the preferred method is for the pulp from the acid treatment to be pressed to about 35% consistency then diluted and sent to the ozone stage. However, washing the pulp at this point also could be employed.

Ozone Treatment Stage

In accordance with the process of the present invention, the acidified nonwood fiber source material proceeds to ozone treatment without a washing step. The omission of the washing step between the acid or acid/chelation stage and the ozone stage eliminates an expensive piece of equipment (a washer), reduces water consumption, and reduces the amount of acid required to achieve the proper pH for the ozone stage.

The ozone treatment stage applies a moderate dosage of ozone, which degrades additional non-cellulosic material and causes a brightness increase in the nonwood fiber source material. Typically, a dosage of ozone of about 0.1 to about 2% weight on ODF ozone, and preferably about 0.4 to about 1% weight on ODF ozone is applied such as by bubbling ozone gas into the acidified nonwood fiber source material slurry. But, the actual dosage of ozone may be altered according to the Kappa number of the incoming pulp and the desired brightness level for the final pulp. As discussed above, the term "Kappa number" denotes a standard test used in the pulp and paper industry to measure residual lignin content of pulp. It is based on the consumption of an oxidant under controlled conditions. A higher Kappa number means that more lignin remains in the pulp, implying that it was pulped or chemically treated more mildly and/or less effectively than a pulp with a lower Kappa number.

In a preferred embodiment, ozonation is done at a low pulp consistency (about 3%). Ozonation at medium and high pulp consistency is also contemplated, given the proper equipment. However, it should be noted that medium-consistency ozonation usually involves the use of high-shear mixing, which may cause fiber damage and drainage rate loss. Similarly, high-consistency ozonation may be non-uniform, causing over-ozonation of certain areas of the fiber and subsequent strength loss. Hence, care should be exercised in the use of medium to high pulp consistency ozonation.

Typically, this stage lasts from about 1 to about 30 minutes, and preferably lasts about 5 to about 15 minutes. Stage temperature is typically maintained at about ambient temperature, e.g., about 25° C. to about 30° C. Indeed, because ozone is more rapidly decomposed at higher temperatures, a preferred embodiment of the present invention involves the lowest possible reaction temperature. Thus, preferably, no heating is applied to the pulp in this stage. Depending on the process steady state temperature, cooling may optionally be provided to the pulp entering the stage or to the filtrate used to provide dilution of the thickened pulp from the acid treatment stage.

Thus, the present invention process utilizes ozone in the third stage to further delignify and brighten the pulp, without serious damage to the pulp fibers and to subsequent sheet strength. Ozone dosage may be readily varied, and the preferred dosage ranges between about 0.4 to about 1.0% weight on ODF. The amount of ozone required is that which produces a pulp with a Kappa number such that the final bleaching stage can increase pulp brightness to the desired final value with a moderate amount of chemical.

In accordance with a preferred embodiment of the present invention, following the ozone stage, the pulp is thoroughly washed then screened and cleaned prior to subsequent bleaching stages.

Bleaching Treatment

This stage uses a moderate application of a bleaching solution, such as an alkaline hydrogen peroxide bleaching solution or a chlorine-based bleaching solution, to complete the removal of substantially all of the non-cellulosic material remaining in the pulp and to increase the pulp brightness to the desired final level. Stage conditions (e.g. temperature and pressure) typically depend on the optimum conditions for a particular bleaching agents. For example, stage conditions may be moderate (e.g. atmospheric conditions—temperatures ranging from about 70° C. to about 90° C.) if bleaching agents such as chlorine-based bleaching agents (e.g. chlorine dioxide, hypochlorite) are used. Additionally, as disclosed below, stage temperatures may be maintained at at least about 100° C., and more preferably, may range from about 105° C. to about 110° C., if an alkaline peroxide bleaching agent is employed.

Typically, the bleaching treatment stage lasts from about 1 to about 120 minutes, including the time associated with adjusting the nonwood fiber source material to stage temperature. The stage temperature is maintained for about 1 to 90 minutes, with about 30 to 90 minutes being preferred.

In accordance with a preferred embodiment of the present invention, hydrogen peroxide is used under pressurized conditions; that is, pressures above atmospheric which permit the bleaching to be done at temperatures of at least about 100° C. (e.g. about 105° C. to about 110° C.). By employing the alkaline peroxide bleaching solution at a temperature of 105–110° C., rather than at an atmospheric pressure temperature of 70–90° C. which nevertheless also may be used, hydrogen peroxide within the solution is able in a single stage and in a moderate amount of time to both remove the bulk of lignin remaining in the pulp and to increase the brightness of the pulp by approximately 30–40 points of ISO brightness. Peroxide stabilizers, e.g. chelants (such as DTPA or DTMPA), sodium silicate, and magnesium sulfate, are also incorporated within the alkaline peroxide bleaching solution. Preferably, after reaction, the pulp is washed thoroughly.

As disclosed in Example 7, the bleaching agent utilized in this stage does not have to be peroxide-based. Rather, any delignifying/brightening chemical agent may be used, although the resulting pulp quality will depend on the specific action of that chemical and process conditions used. In Example 7, chlorine dioxide, a commonly used chlorine-based bleaching agent, was applied. Lignin was effectively removed, as observed with the peroxide bleaching agent, although the final brightness was somewhat lower.

Optional Step—Screening and Cleaning Stage

The use of a screening and cleaning stage between the ozone and bleaching stages, rather than earlier in the process, is also contemplated in accordance with a preferred embodiment of the present inventive process. Placement of the screening stage at this point, rather than after the alkaline extraction stage, reduces loss of material. The intensive dilution employed with the screening also serves as a source of a good wash, thus decreasing the amount of washing in the washing device employed prior to or after the bleaching treatment stage. The intensive dilution/washing may be carried out prior to or after screening, depending on process requirements.

However, the invention is not limited to the use of screening at this point. Rather, the screening stage can be placed after the alkaline extraction stage, and an acceptable pulp would also be produced. Placement of the screening stage can thus depend on the raw material and on the quality and economic requirements for a given mill.

Pulping Schematic

The Figures presented herein have been included to schematically illustrate preferred modes of the invention. Certain aspects of the Figures are described in terms of techniques and procedures found or contemplated by the present inventors to work well in practice of the invention. The schematics presented in the Figures are based upon the use of existing commercially available equipment and machinery. In light of the present disclosure and the general level of skill in the art, those of ordinary skill in the art will appreciate that the schematics presented in the Figures are intended to be exemplary only and that numerous changes, modifications and alterations can be employed without departing from the spirit and scope of the invention. For example, a dry system could be used for fiber preparation instead of the wet system schematically illustrated in FIG. 1, and batch digesters could be employed instead of the continuous digesters schematically illustrated in FIGS. 2 and 3.

Referring now to FIGS. 1–6 of the drawings, where like reference numerals refer to like parts throughout, the process of the present invention is described schematically. In accordance with an object of the present invention, all individual pieces of equipment referred to hereinbelow are readily available commercially from a variety of manufactures, including for example, Sunds Defibrator Co. of Norcross, Ga., and Beloit Corporation of Nashua, N.H.

Referring particularly to FIG. 1, a schematic of an optional fiber preparation stage FP as performed in a preferred embodiment of the process of the present invention is depicted schematically. Stalks of material (e.g. corn stalks) are harvested whole and chopped into pieces 2–4 inches in length (this dimension typically depends on the types of conveyors and feed screws selected). Both core and bast materials are used, without separation. Separated material may be used, if desired, to get more specified properties. The raw nonwood fiber source material is introduced initially into tub grinder 10 for preliminary grinding and is then transferred via conveyor 12 to hydrapulper 14 for washing. The now damp raw nonwood fiber source material is transferred via pump 16 to magnetic separator 18 to facilitate separation of magnetically charged particulates from the raw nonwood fiber source material. The nonwood fiber source material is then introduced into a second hydrapulper 20 for an additional washing step, and then into liquid cyclone centrifuge 24 via pump 22. The raw nonwood fiber source material is then de-watered via de-watering screen 26. The cleaned raw nonwood fiber source material is ready for transport to the alkaline extraction stage E of the process of the present invention.

Continuing with FIG. 1, rejects from de-watering screen 26 are filtered through sidehill screen 28, and the sidehill screen 28 rejects are transported to compactor 30. Rejects from liquid cyclone centrifuge 24 are transported directly to compactor 30. Water from sidehill screen 28 is conserved via transport to water tank 32. Indeed, the environmentally benign aspects of the process of the present invention are illustrated by the recovery of water from sidehill screen 28 and from compactor 30 in water tank 32. Dilution water may be then pumped from water tank 32 for use as a wash in hydrapulper 14, or may be treated prior to disposal via effluent treatment device 34.

Figure 2:
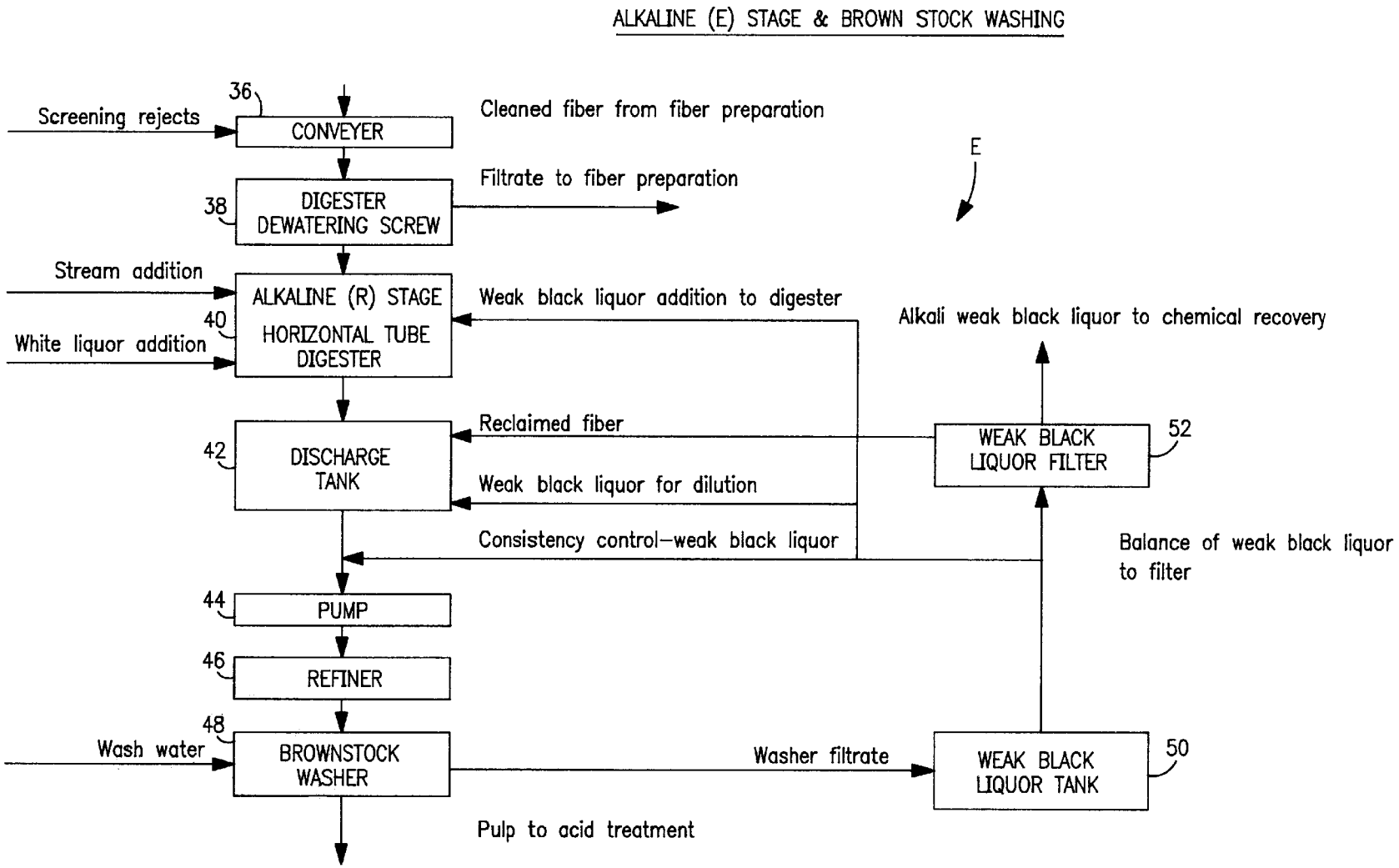
FIG. 2 is a schematic representation of an alkaline digestion stage E of the process of the present invention.

Referring now to FIG. 2, the alkaline extraction stage E of a preferred embodiment of the process of the present invention is depicted schematically. Cleaned nonwood fiber pulp from fiber preparation stage FP is introduced via conveyor 36 to digester de-watering screw 38 wherein excess water is removed from the cleaned nonwood fiber pulp. The pulp is then introduced into horizontal tube digester 40 for alkaline extraction of lignin as described in detail herein.

Continuing with FIG. 2, the alkaline-digested nonwood fiber pulp is then introduced into discharge tank 42 and is subsequently pumped via pump 44 into mechanical refiner 46 for gentile mechanical defibering/refining. The alkaline digested nonwood fiber source material is then washed with water in brownstock washer 48. Brownstock washer 48 is so named because at this point the pulp comprises dark colored cellulosic fibers, or "brownstock". The nonwood fiber pulp is then ready for introduction into the acid and ozone treatment stages A and Z of the process of the present invention.

Continuing with FIG. 2, filtrate from brownstock washer 48 (called "weak black liquor") is collected in into weak black liquor tank 50 and filtered using weak black liquor filter 52. The weak black liquor may then be disposed of via chemical recovery procedures; may be re-introduced into digester 40; may be re-introduced into discharge tank 42 for use in dilution of the pulp; or may be re-introduced into refiner 46 via pump 44 as a contingency control. Any fiber reclaimed from weak black liquor filter 52 is re-introduced into discharge tank 42 for reincorporation into an alkaline-extracted nonwood fiber pulp and subsequent acid treatment.

Figure 3:
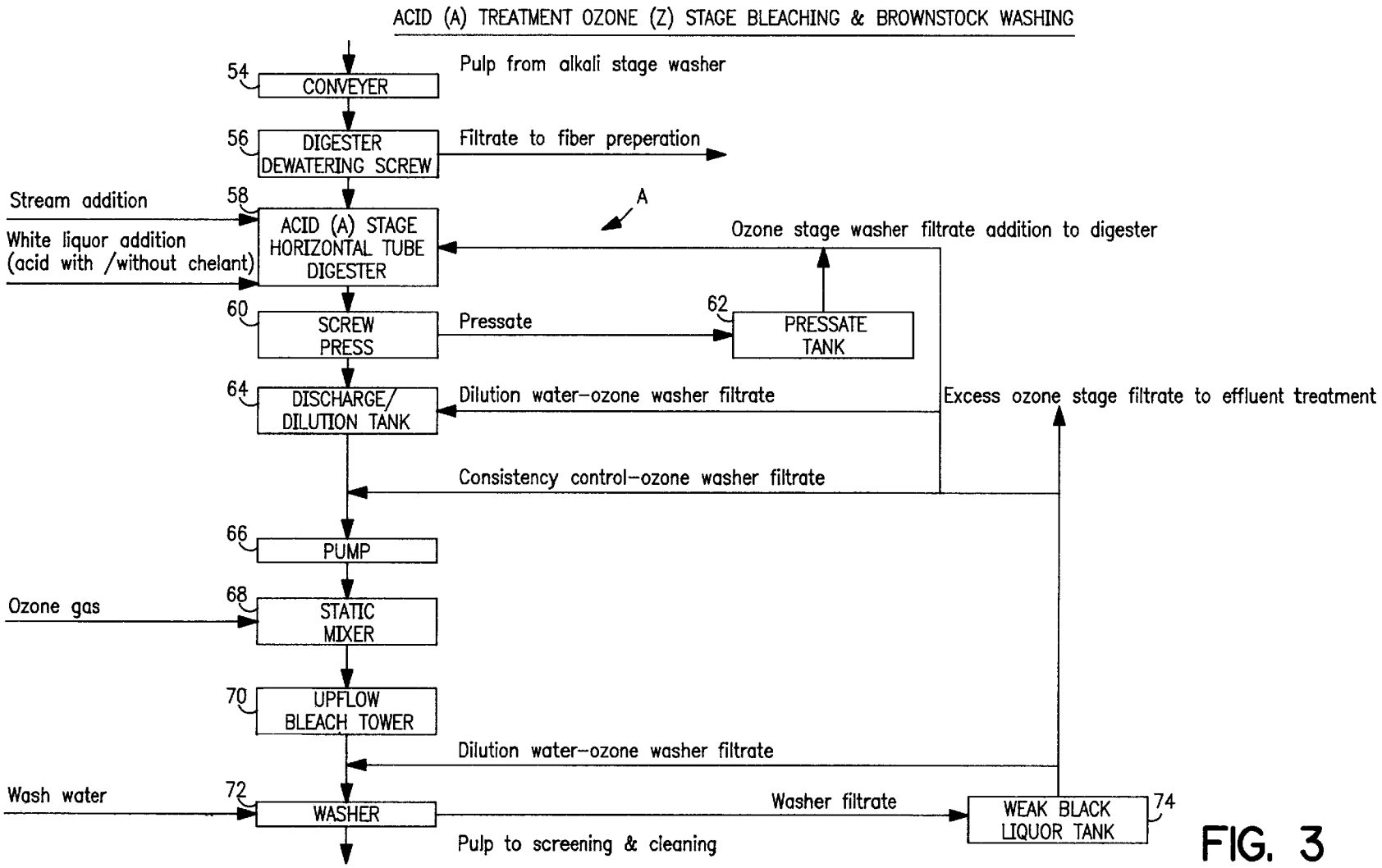
FIG. 3 is a schematic representation of an acid treatment stage A and ozone treatment stage Z of the process of the present invention.

Referring now to FIG. 3, an acid treatment stage A and an ozone treatment stage Z of a preferred embodiment of the process of the present invention are depicted schematically. The alkaline-digested nonwood fiber source material is transported via conveyor 54 to digester de-watering screw 56 forde-watering and subsequent introduction into horizontal tube digester 58 for acid treatment as described herein.

The acidified nonwood fiber source material is then introduced into screw press 60 to be pressed to about 35% pulp consistency. The pulp is then introduced to discharge/dilution tank 64 for dilution and transport to ozone treatment stage Z. A pressate solution from screw press 60 is collected within pressate tank 62 for reuse in horizontal tube digester 58.

Continuing with FIG. 3, the acidified nonwood fiber pulp is pumped via pump 66 into static mixer 68 and upflow bleach tower 70 where ozone gas is introduced as described herein. The ozone-bleached nonwood fiber pulp is then washed in washer 72 and transported for screening and cleaning as described below. Filtrate from washer 72 is collected in weak black liquor tank 74 for reuse in washer 72, pump 66, discharge tank 64, or horizontal tube digester 58. Optionally, filtrate from weak black liquor tank 74 can be discharged for effluent treatment and disposal.

Figure 4:
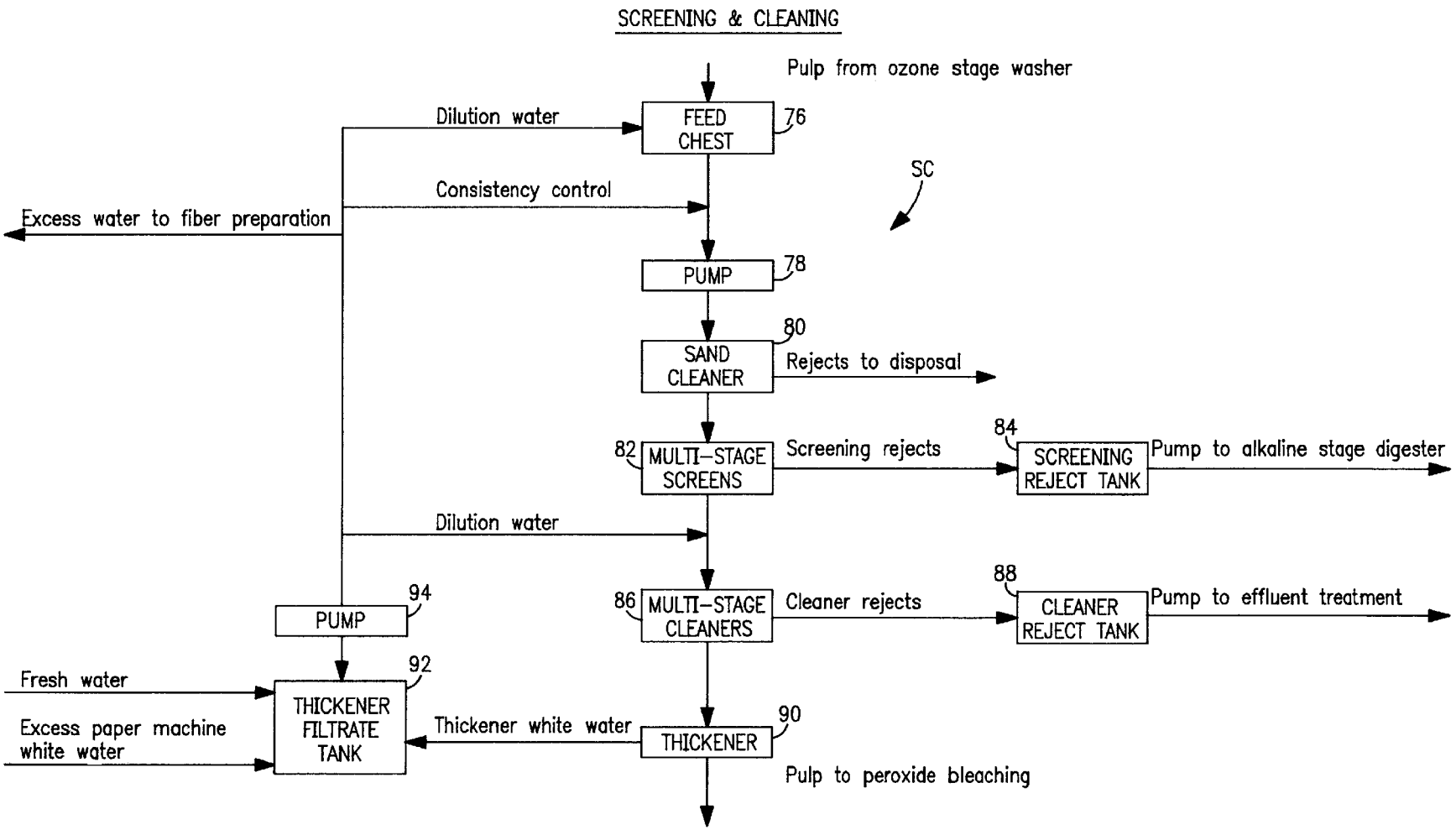
FIG. 4 is a schematic representation of a screening and cleaning stage SC of the process of the present invention.

Referring now to FIG. 4, a screening and cleaning stage SC of a preferred embodiment of the process of the present invention is depicted schematically. The bleached nonwood fiber source material from ozone treatment stage Z is introduced into feed chest 76 and subsequently pumped via pump 78 to sand cleaner 80. Rejects from sand cleaner 80 are recovered for disposal. The nonwood fiber source material then passes through multi-stage screens 82 and through multi-stage cleaners 86. Reject materials are recovered from multi-stage screens 82 and multi-stage cleaners 86 and collected in screening reject tank 84 and cleaner reject tank 88 for reuse in alkaline stage digester 40 (FIG. 2) or for disposal via effluent treatment device 34 (FIG. 1), respectively. The nonwood fiber pulp is then thickened in thickener 90 for subsequent introduction into the bleaching stage B of the process of the present invention as described below.

Continuing with reference to FIG. 4, a white water filtrate is obtained from thickener 90 and is collected in thickener filtrate tank 92. Fresh water and excess paper machine white water are also collected in thickener filtrate tank 92 and pumped via pump 94 to multi-stage cleaners 86 for reuse as dilution water or to water tank 32 (FIG. 1) for storage and reuse as dilution water in hydrapulper 14 (FIG. 1).

Figure 5:
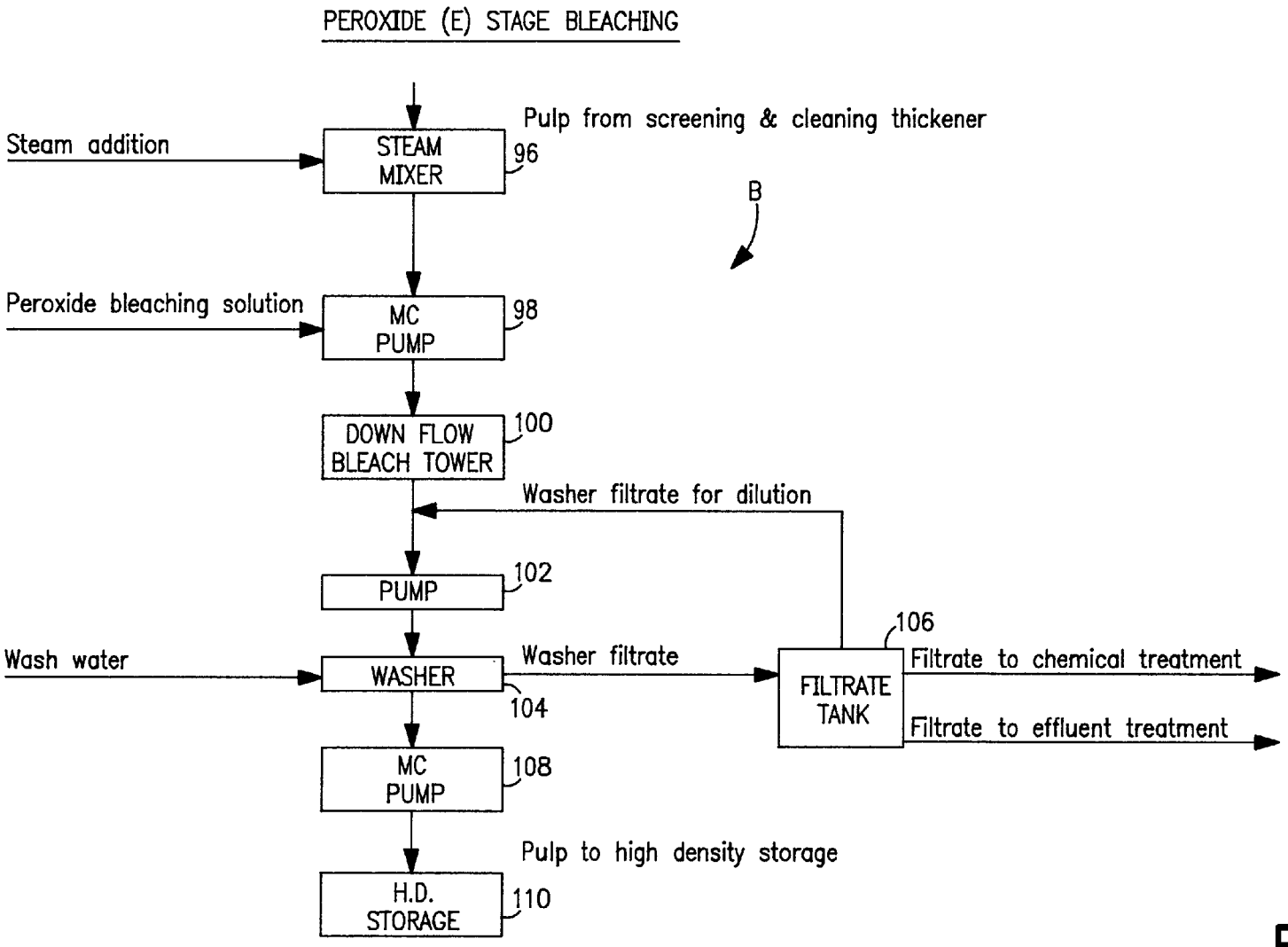
FIG. 5 is a schematic representation of a bleaching stage B of the process of the present invention.

Referring now to FIG. 5, a bleaching stage B of a preferred embodiment of the process of the present invention is depicted schematically. The nonwood fiber pulp from screening and cleaning stage SC is introduced along with steam to steam mixer 96. The nonwood fiber pulp is then pumped via pump 98 into downflow bleach tower 100. A bleaching solution as described herein is also introduced via pump 98 into downflow bleach tower 100, and the nonwood fiber pulp is treated at above atmospheric pressure with the bleaching solution as described herein.

Continuing with FIG. 5, after bleaching, the nonwood fiber pulp is pumped via pump 102 into a washer 104 wherein the nonwood fiber pulp is washed with water. The nonwood fiber pulp, now a suitable paper-making pulp having the brightness and freeness characteristics described herein, is pumped via MC pump 108 to a high density storage tank 110. Filtrate from washer 104 is collected in filtrate tank 106. The collected filtrate is then reused as a dilution liquid in pump 102, or is discarded via chemical recovery or effluent treatment procedures.

Figure 6:
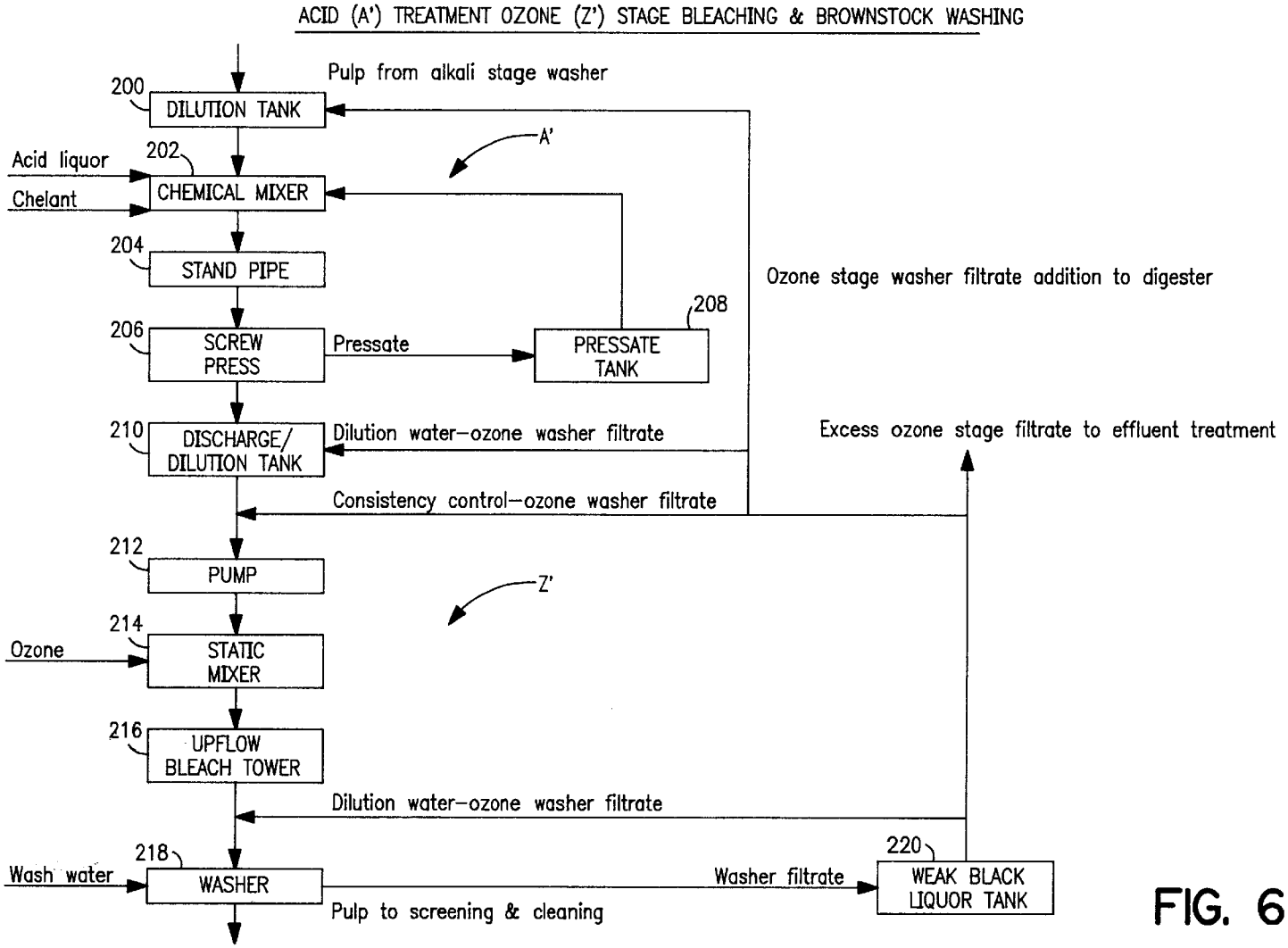
FIG. 6 is a schematic representation of an alternative embodiment of an acid treatment stage A' and an ozone treatment stage Z' of the process of the present invention.
Figure 1:
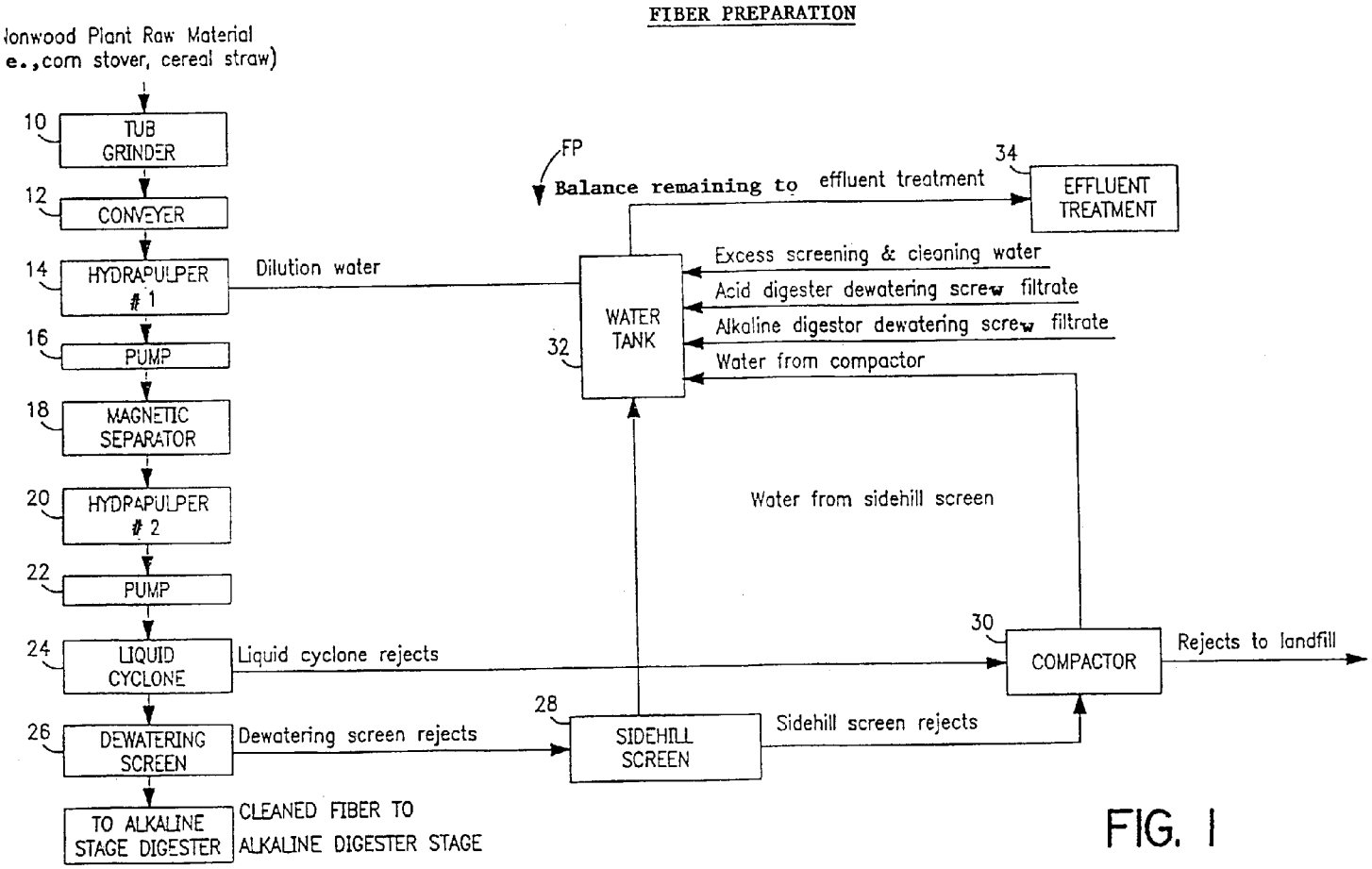
Figure 2:
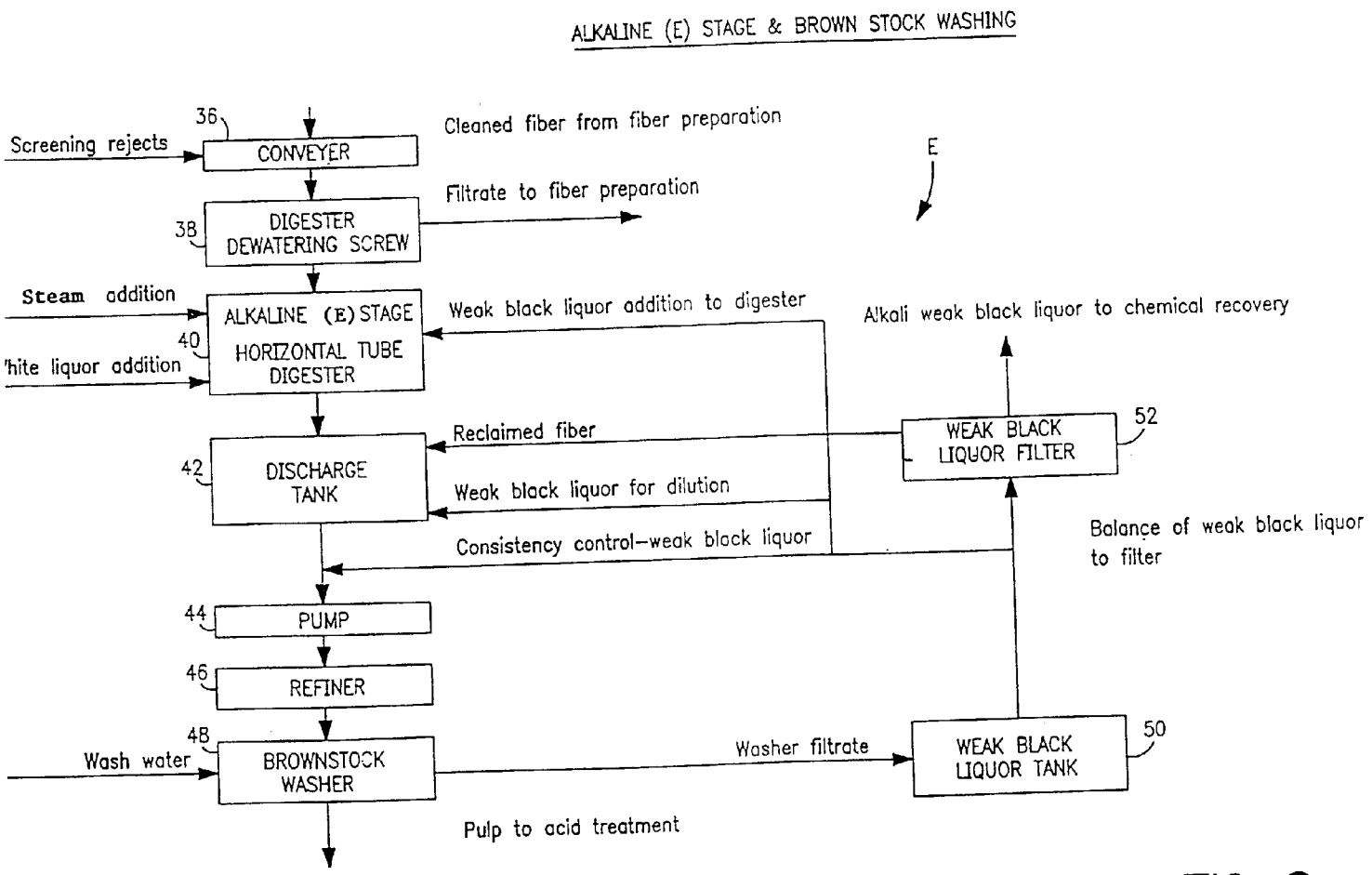
Figure 3:
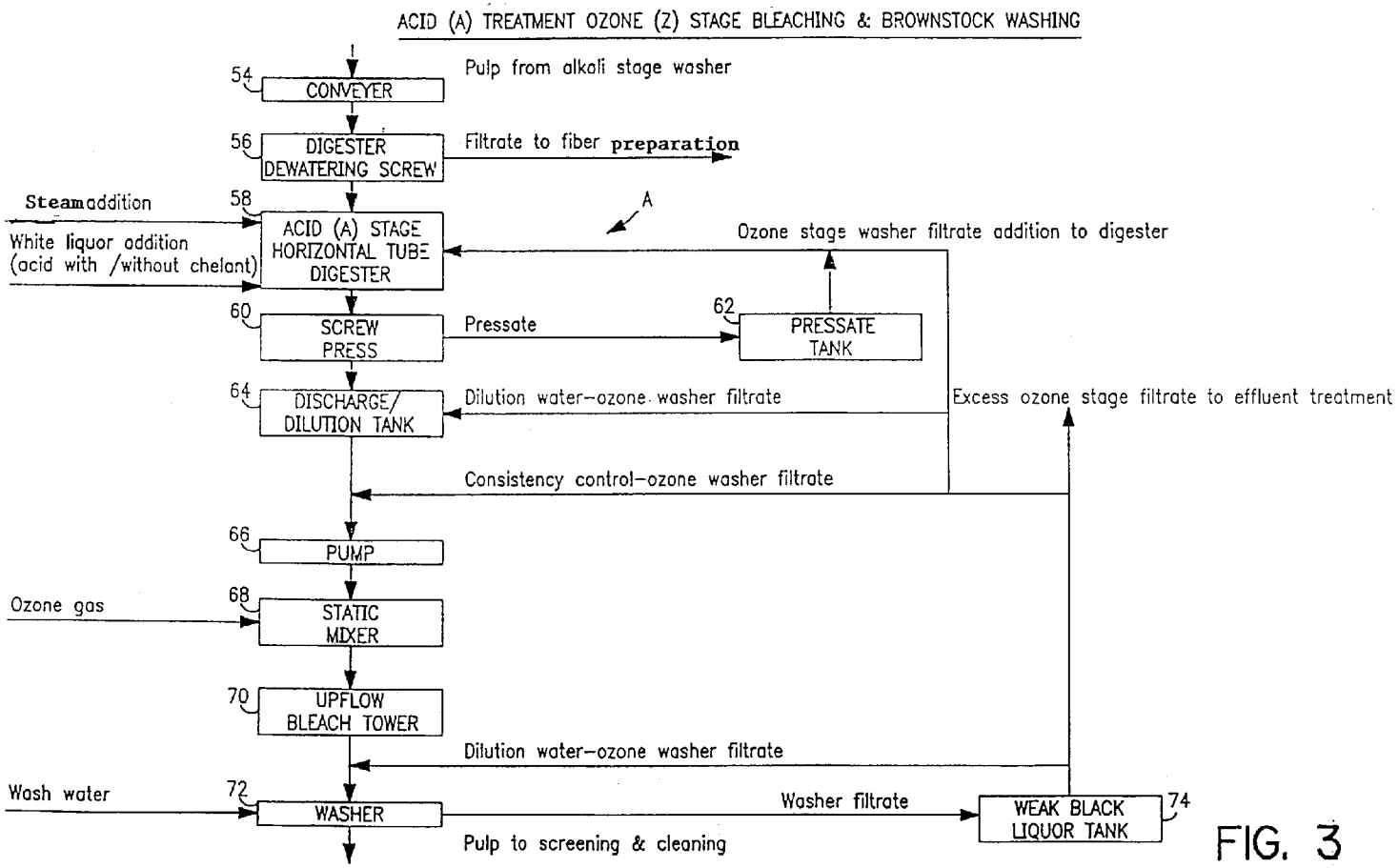
Figure 4:
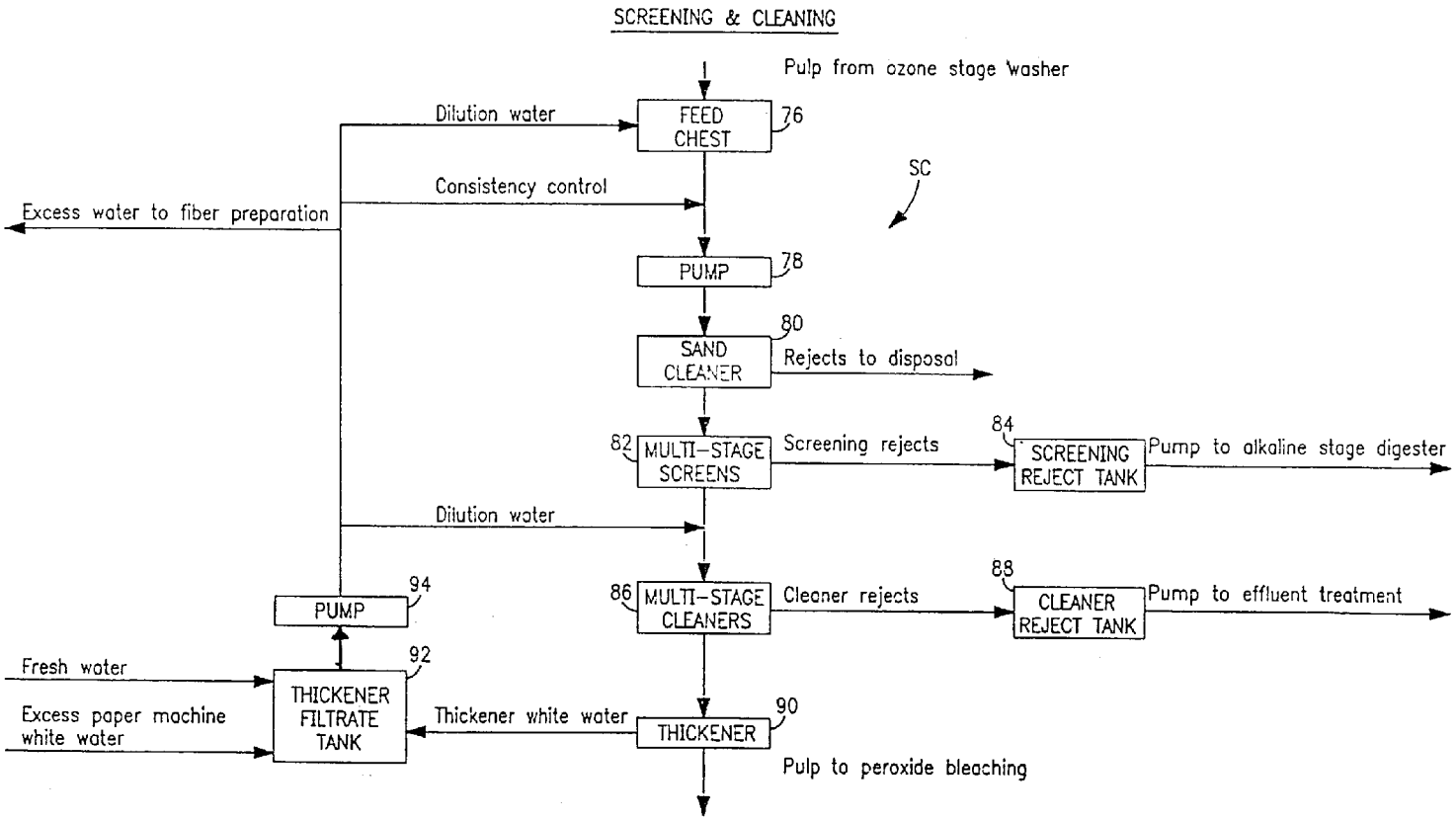
Figure 5:
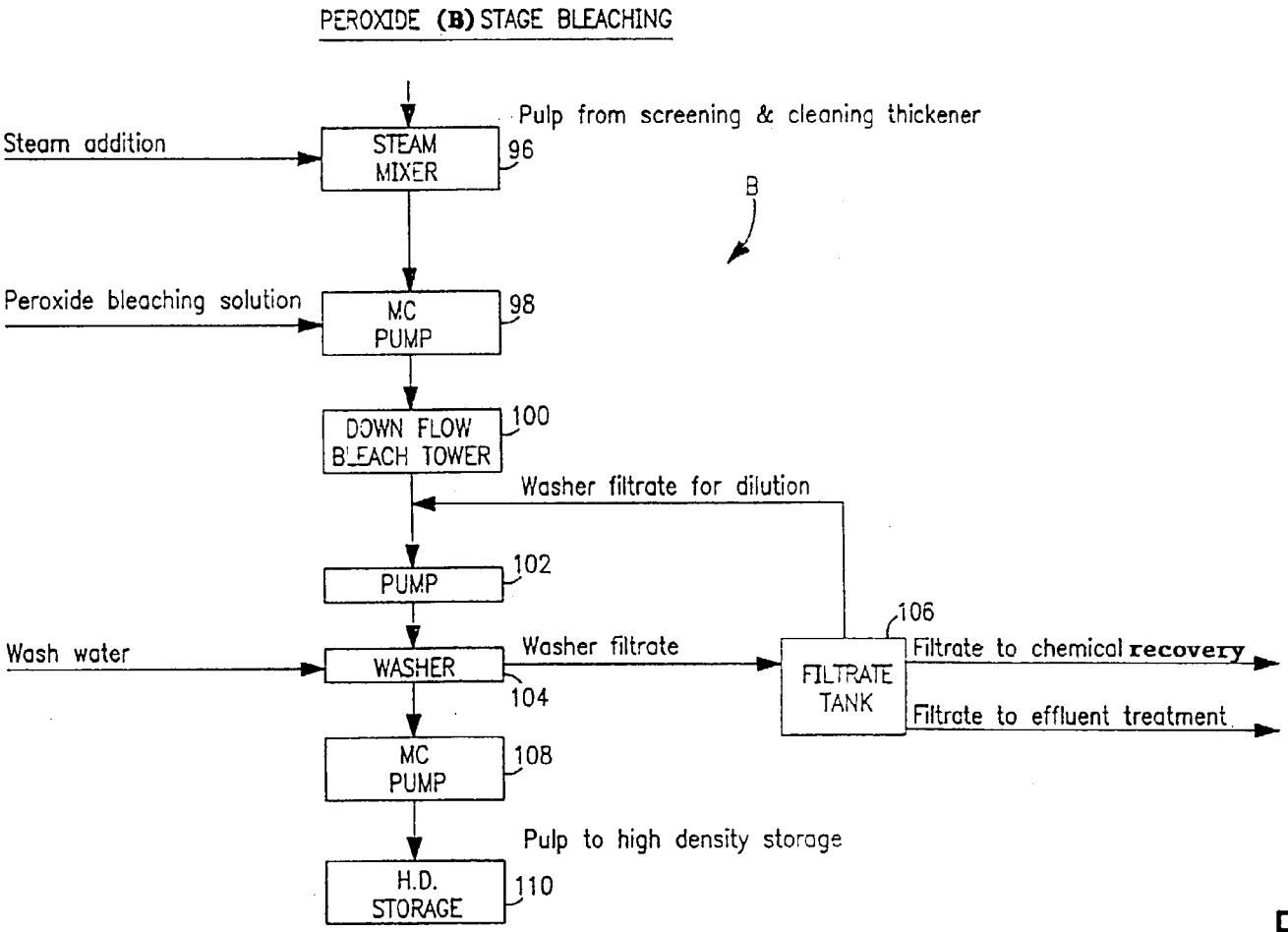

Referring now to FIG. 6, an alternative embodiment of the present invention is depicted schematically. Particularly, an alternative acid treatment stage A' and ozone treatment stage Z' of the process of the present invention are depicted schematically. Alkaline-extracted nonwood fiber pulp is introduced into dilution tank 200 for dilution to a pulp consistency of about 5 to 10%. The diluted nonwood fiber pulp slurry is introduced into chemical mixer 202 along with an acid solution comprising a chelant in accordance with the present invention, and then into stand pipe 204 for acid treatment as described herein. The acid treated nonwood fiber pulp is then introduced into discharge/dilution tank 210 via screw press 206. A pressate solution is recovered from screw press 206 and stored in pressate tank 208 for reuse in chemical mixer 202 if desired.

Continuing with FIG. 6, the acid treated nonwood fiber pulp is again diluted to a pulp consistency of about 3 to about 10% and then introduced into upflow bleach tower 216 via pump 212 and static mixer 214. Ozone gas is introduced into static mixer 214 along with the acid-treated nonwood fiber pulp for ozone treatment in upflow bleach tower 216 as described herein. Following ozone treatment, the nonwood fiber source material is washed in washer 218 with distilled water. The acid- and ozone-treated nonwood fiber pulp then proceeds to the screening and cleaning stage SC of the present invention as described above and as depicted schematically in FIG. 4.

Continuing with FIG. 6, a filtrate from washer 218 is collected in weak black liquor tank 220 for subsequent reuse in washer 218, for use in controlling the consistency of the nonwood fiber pulp as it is pumped from discharge tank 210 into static mixer 214 via pump 212, or for disposal via effluent treatment.

EXAMPLES

The Examples presented below have been included to illustrate preferred modes of the invention. Certain aspects of the Examples are described in terms of techniques and procedures found or contemplated by the present inventors to work well in the practice of the invention. The Examples are exemplified through the use of standard laboratory practices of the inventors. In light of the present disclosure and the general level of skill in the art, those of ordinary skill in the art will appreciate that the Examples are intended to be exemplary only and that numerous changes, modifications and alterations can be employed without departing from the spirit and scope of the invention.

EXAMPLE 1

Corn Stover—Acid Stage Using Nitric Acid

Air-dried whole corn stover (not depithed) was chopped into about 1- to about 3-inch lengths and soaked in tap water for 30 minutes to provide a washing action. This material was placed into a rotating pressure reactor and treated under the following conditions:

| | |
|---|---|
| Alkaline Extraction Stage: | 12% sodium hydroxide (NaOH) on ODF<br>8:1 liquor-to-fiber ratio<br>Maximum temperature: 115–118° C.<br>Time to temperature: 30 minutes<br>Time at temperature: 60 minutes |

After this stage, the free liquor was drained from the material. The drained material was passed through a twin-disk refiner with a plate clearance of 0.035 inches to promote defibration. After refining, the resulting pulp was washed thoroughly. The washed pulp was then treated under the following conditions:

| | |
|---|---|
| Acid Chelation Stage: | 5% nitric acid on ODF<br>Starting pH 1.4<br>DTPA 0.5% on ODF (chelant)<br>5:1 liquor-to-fiber ratio<br>Temperature: 80° C.<br>Time at temperature: 60 minutes |

After this stage, the free liquor was drained from the material by centrifuging to a consistency of approximately 35%. The material was immediately placed into a sealed reactor with a vigorous mixing rotor, diluted with distilled water to 3% consistency, and the pH was adjusted with sulfuric acid to 1.5.

Ozone gas was then bubbled into the mixing slurry. The following conditions were used for the ozone stage:

| | |
|---|---|
| Ozone Stage: | 3% consistency<br>Initial pH: 1.5<br>Temperature: 30° C.<br>Ozone dosage: 0.7–0.9% on ODF<br>Reaction time: 10 minutes |

At the end of the reaction, the pulp was screened in a vibrating flat screen equipped with 0.010-inch slots. The accepts from the screen were furtherwashed with distilled water. The pulp was centrifuged to remove excess water and was then treated under the following conditions:

| | |
|---|---|
| Bleaching Stage: | 12% consistency<br>Sodium hydroxide dosage: 5% on ODF<br>Hydrogen peroxide dosage: 4% on ODF<br>DTMPA (high-temperature chelant) dosage: 0.2% on ODF<br>Magnesium sulfate dosage: 0.5% on ODF<br>Sodium silicate dosage: 0.5% on ODF<br>Temperature: 105° C.<br>Reaction time: 90 minutes |

The following results were obtained:

Kappa after first alkali stage: 20.1

| | |
|---|---|
| Final pulp: | Brightness: 87.4% ISO<br>Freeness: 619 ml CSF<br>Kappa number: 1.3<br>Total yield: 39.1%<br>Peroxide dosage consumption: 89.3% |

Strength properties, after refining in a PFI mill, were obtained as shown in Table 1.

TABLE 1

Strength and Optical Data
Bleached Corn Pip (87–88 ISO)
Averages are shown, with standard deviation values in parentheses.

| PFI Revolutions | 0 | 750 | 1500 | 3000 |
|---|---|---|---|---|
| Freeness, ml CSF | 619 | 350 | 208 | 92 |
| Basis Weight, g/m$^2$ | 62.6 | 64.4 | 64.1 | 63.2 |
| Caliper, mils | 3.69 | 3.42 | 3.11 | 3.15 |
| Apparent Density, g/cm$^3$ | 0.668 | 0.741 | 0.811 | 0.790 |
| Bulk, cm$^{3/g}$ | 1.50 | 1.35 | 1.23 | 1.27 |
| Brightness, % ISO | 87.4 | 87.4 | 87.4 | 87.4 |
| TAPPI Opacity, % | 65.8 | 59.4 | 52.4 | 44.3 |
| (0.90) | (2.2) | (1.0) | (1.3) | |
| Printing Opacity, % | 67.0 | 60.7 | 55.4 | 49.4 |
| (1.3) | (1.7) | (1.2) | (2.6) | |
| Tear Factor, dm$^2$ | 75.9 | 48.0 | 47.7 | 54.4 |
| (9.9) | (5.9) | (8.0) | (13.9) | |
| Burst Factor, $g_f$/cm$^2$/ | 31.1 | 48.6 | 52.4 | 61.7 |
| $g_f$/m$^2$ | (1.5) | (3.4) | (4.4) | (3.4) |
| Tensile Breaking Length, | 5.02 | 7.15 | 6.70 | 6.10 |
| km | (0.16) | (0.28) | (0.39)* | (0.91)* |
| % Stretch | 3.06 | 2.78 | 2.52 | 2.12 |
| (0.28) | (0.37) | (0.45) | (0.74) | |
| Tensile Energy | 71.0 | 89.0 | 76.0 | 58.4 |
| Absorption, J/m$^2$ | (8.4) | (15.6) | (20.5) | (30.1) |

*The tensile test samples for 1500 and 3000 revolutions broke at the clamp.

Kajaani FS-200 Fiber Length Distribution Data

| | Bleached Corn Pulp | Bleached Mixed Southern Hardwood Market Pulp |
|---|---|---|
| Arithmetic avg. length, mm | 0.44 | 0.40 |
| Weight-weighted avg. length, mm | 2.06 | 1.36 |
| Length-weighted avg. length, mm | 1.09 | 1.00 |
| Coarseness, mg/m | 0.106 | — |
| P (fines) fraction, number % | 41.32 | 58.64 |

EXAMPLE 2

Corn Stover—Acid Stage Using Nitric Acid Without Chelating Agent

The conditions for this Example were identical to those for Example 1, except that the DTPA chelating agent in the acid treatment stage was omitted. The following results were obtained:

Kappa after first alkali stage: 20.1

| | |
|---|---|
| Final pulp: | Brightness: 82.9% ISO<br>Freeness: 575 ml CSF<br>Kappa number: 1.2<br>Total yield: 39.6%<br>Peroxide dosage consumption: 99.1% |

EXAMPLE 3

Corn Stover—Acid Stage Using Acetic Acid

The purpose of this Example was to demonstrate the use of a milder, organic acid (e.g. acetic acid) in the present inventive process, to obtain results similar to those obtained by using a strong mineral acid. The conditions for this Example were identical to those for Example 1, except that acetic acid was used instead of nitric acid in the acid treatment stage, and 25% acid on ODF was added to achieve an initial pH of 3.4. The following results were obtained:

Kappa after first alkali stage: 20.1

| | |
|---|---|
| Final pulp: | Brightness: 86.2% ISO<br>Freeness: 572 ml CSF<br>Kappa number: 1.5<br>Total yield: 38.2%<br>Peroxide consumption: 97.3% |

EXAMPLE 4

Corn Stover—Acid Stage Using Sulfuric Acid

The purpose of this Example was to demonstrate the use of sulfuric acid, the cheapest and most predominant industrial acid, in the acid treatment stage of the present inventive process, using milder process conditions as compared to those used for wood-based acid chelation. The conditions for this Example were identical to those for Example 1, except that the following conditions were used in the acid treatment stage:

| | |
|---|---|
| Acid Treatment stage: | Sulfuric acid to initial pH 1.5<br>Consistency 6%<br>Temperature: 60° C.<br>Time: 30 minutes |

The following results were obtained:

Kappa after first alkali stage: 20.5

| | |
|---|---|
| Final pulp: | Brightness: 88.0% ISO<br>Freeness: 594 ml CSF<br>Kappa number: 1.7<br>Total yield: 35.7%<br>Peroxide dosage consumption: 99.1% |

EXAMPLE 5

Corn Stover—Alkaline Stage Using Potassium Hydroxide

The purpose of this Example was to demonstrate the use of potassium hydroxide, an alkali source with contemplated environmental benefits, in the present inventive process. The conditions for this Example were identical to those for Example 4, except that 15.6% potassium hydroxide was charged on ODF in the alkaline extraction stage. The following results were obtained:

Kappa after first alkali stage: 24.2

| | |
|---|---|
| Final pulp: | Brightness: 84.6% ISO<br>Freeness: 570 ml CSF<br>Kappa number: 2.6<br>Total yield: 41.8%<br>Peroxide consumption: 94.8% |

EXAMPLE 6

Wheat Straw

The purpose of this Example was to demonstrate the effectiveness of the present inventive process on other promising agricultural residues, in this case, wheat straw. Air-dried wheat straw was chopped into 2–3-inch lengths. Other process conditions were identical to those used for Example 4. The following results were obtained:

Kappa after first alkali stage: 32.0

| | |
|---|---|
| Final pulp: | Brightness: 70.0% ISO<br>Freeness: 476 ml CSF<br>Kappa number: 10.2<br>Total yield: 37.8%<br>Peroxide dosage consumption: 98.6% |

As anticipated, the more dense and more pectinous nature of the wheat stalk makes it more difficult for the alkali to penetrate and react under the conditions used in the alkaline digestion stage, resulting in a higher Kappa number than that observed for the corn stover. The higher Kappa number typically does not permit the higher final brightness values to be achieved, and the final Kappa number is significantly higher than for corn stover. It is contemplated that increasing the application of ozone and/or peroxide permits a higher-final brightness to be achieved. Similarly, the amount of alkali charged in the alkaline extraction stage may be increased to reduce the Kappa number to the value of approximately 20 that was obtained for corn stover. It is also contemplated that the use of a shredding device or other device able to mechanically open up the straw stem structure permits better reaction of alkali with the raw material, thereby decreasing the Kappa number after the alkaline extraction stage and improving final brightness.

EXAMPLE 7

Wheat Straw—Chlorine Dioxide Bleaching Agent in the Bleaching Stage

The purpose of this Example was to demonstrate that other bleaching agents may be used in the bleaching stage of the present inventive process. Instead of hydrogen peroxide, chlorine dioxide was used under the following conditions:

| | |
|---|---|
| Chlorine Dioxide Stage: | 3.5% consistency<br>Initial pH: 3<br>Temperature: 50° C.<br>Chlorine dioxide dosage: 3.1% on OD fiber<br>Reaction time: 60 minutes |

Other process conditions were identical to those used for Example 4. The following results were obtained:

| | |
|---|---|
| Final pulp: | Brightness: 52.6% ISO<br>Freeness: 426 ml CSF<br>Kappa number: 11.0<br>Total yield: 36.3%<br>Chlorine dioxide dosage consumption: 99.5% |

The application of chlorine dioxide resulted in a reduction in Kappa number and an increase in brightness, although the effect at this dosage was lower than that observed with peroxide bleaching. Clearly, more chlorine dioxide may be applied, and it is contemplated that the amount may optionally be doubled, thereby decreasing the Kappa number and increasing the final brightness to a value of at least about 80 ISO.

It will be understood that various details of the invention may be changed without departing from the scope of the invention. Furthermore, the foregoing description is for the purpose of illustration only, and not for the purpose of limitation—the invention being defined by the claims.

What is claimed is:

1. A process for producing a pulp suitable for making paper from a nonwood fiber source material, the process comprising:

(a) providing a nonwood fiber source material;

(b) extracting the nonwood fiber source material with an alkaline pulping solution at at least about atmospheric pressure;

(c) reducing the pH of the nonwood fiber source material pH formed in step (b) to an acidic pH with an acid solution;

(d) treating the nonwood fiber source material having an acidic pH formed in step (c) with ozone; and (e) treating the nonwood fiber source material of step (d) with a bleaching solution comprising a bleaching agent different from the ozone of step (d) to form a paper-making pulp, wherein the pulp has a freeness level of at least 400 mL CSF or greater and a brightness level of at least 70% ISO.

2. The method of claim 1, wherein the nonwood fiber source material is selected from a group comprising corn stover, kenaf, industrial hemp, sisal, rye grass straw, wheat straw, rice straw, bagasse, hesperaloe, flax straw and combinations thereof.

3. The method of claim 2, wherein the nonwood fiber source material is corn stover, wheat straw, bagasse or combinations thereof.

4. The process of claim 1, wherein said extracting the nonwood fiber source material with an alkaline pulping solution occurs at a temperature ranging from about 80° C. to about 120° C.

5. The process of claim 1, wherein said alkaline pulping solution comprises an alkaline hydroxide pulping solution.

6. The process of claim 5, wherein alkaline hydroxide is present in said alkaline hydroxide pulping solution in a dosage ranging from about 10% weight to about 30% weight on ODF.

7. The process of claim 5, wherein alkaline hydroxide in said alkaline hydroxide pulping solution is selected from the group consisting of sodium hydroxide, potassium hydroxide, ammonium hydroxide, calcium hydroxide and combinations thereof.

8. The process of claim 1, wherein the pH is reduced in step (c) to a pH within a range of about 1 to about 3.

9. The process of claim 1, wherein said reducing the pH of the nonwood fiber source material to an acidic pH with an acid solution occurs at a temperature ranging from about 50° C. to about 70° C. and for a time ranging from about 20 minutes to about 30 minutes.

10. The process of claim 1, wherein the acid solution comprises an acid selected from the group consisting of a mineral acid, an organic acid and combinations thereof.

11. The process of claim 10, wherein the acid is selected from the group consisting of sulfuric acid, nitric acid, phosphoric acid, acetic acid and combinations thereof.

12. The process of claim 1, wherein the acid solution further comprises a chelating agent.

13. The process of claim 1, wherein the ozone is present in a dosage ranging from about 0.4% weight to about 1% weight on ODF.

14. The process of claim 1, wherein said treating the nonwood fiber source material having an acidic pH with ozone produces a pulp having a Kappa number of at least as low as 5.

15. The process of claim 1, wherein said treating the nonwood fiber source material with a bleaching solution occurs at a temperature of at least about 100° C. and said bleaching solution comprises an alkaline peroxide bleaching solution.

16. The process of claim 15, wherein the temperature is a temperature ranging from about 105° C. to about 110° C.

17. The process of claim 15, wherein said alkaline peroxide bleaching solution comprises sodium hydroxide, hydrogen peroxide, magnesium sulfate, sodium silicate and a chelant.

18. The process of claim 1, wherein the bleaching solution comprises a chlorine dioxide or other chlorine-based bleaching solution.

19. The process of claim 1, further comprising cleaning the nonwood fiber source material with at least one filtering screen after the step of treating the nonwood fiber source material having an acidic pH with ozone and before the step of treating the nonwood fiber source material with a bleaching solution.

20. The process of claim 1, further comprising adjusting the nonwood fiber source material to a consistency of at least about 35% after the step of reducing the pH of the nonwood fiber source material to an acidic pH with an acid solution, and then diluting the nonwood fiber source material to a lower consistency with or without washing the nonwood fiber source material prior to the step of treating the nonwood fiber source material having an acidic pH with ozone.

21. The process of claim 20, wherein the consistency of the nonwood fiber source material ranges from about 3% to about 10%.

22. The process of claim 1, further comprising diluting the nonwood fiber source material having an acidic pH to a consistency ranging from about 1% to about 10%.

23. The process of claim 1, wherein the papermaking pulp has a brightness level of at least 80% ISO.

24. The process of claim 1, wherein the papermaking pulp has a freeness level of at least 550 mL CSF or greater.

25. The process of claim 1, wherein the papermaking pulp has a Kappa value of at least as low as 5.

26. The process of claim 25, wherein the papermaking pulp has a Kappa value ranging downwardly from about 5 to about 1.

27. A process for producing a pulp suitable for making paper from a nonwood fiber source material, the process comprising the sequential steps of:

(a) providing a nonwood fiber source material;

(b) extracting the nonwood fiber source material with an alkaline pulping solution for about 1 to about 90 minutes at a pressure ranging from about atmospheric pressure to about 30 psig and at a temperature ranging from about ambient temperature to about 150° C.;

(c) treating the nonwood fiber source material with an acid solution at a temperature ranging from ambient temperature to about 90° C. and for a time ranging from about 30 to about 60 minutes to reduce the pH to an acidic pH;

(d) dewatering the nonwood fiber source material to a consistency of at least about 35% and then diluting the nonwood fiber source material to a lower consistency ranging from about 1% to about 10%;

(e) treating the nonwood fiber source material having an acidic pH with ozone; and (f) treating the nonwood fiber source material with a bleaching comprising a bleaching agent different from the ozone of step (e) to form a papermaking pulp having a Kappa value of at least as low as 5, a freeness level of at least 400 mL CSF or greater and a brightness level of at least 70% ISO.

28. The method of claim 27, wherein the nonwood fiber source material is selected from a group comprising corn stover, kenaf, industrial hemp, sisal, rye grass straw, wheat straw, rice straw, bagasse, hesperaloe, flax straw and combinations thereof.

29. The method of claim 28, wherein the nonwood fiber source material is corn stover, wheat straw, bagasse or combinations thereof.

30. The process of claim 27, wherein said digesting the nonwood fiber source material with an alkaline pulping solution occurs at a temperature ranging from about 80° C. to about 120° C. and for a time ranging from about 30 minutes to about 60 minutes.

31. The process of claim 27, wherein said alkaline pulping solution comprises an alkaline hydroxide pulping solution.

32. The process of claim 31, wherein alkaline hydroxide is present in said alkaline hydroxide pulping solution in a dosage ranging from about 10% weight to about 30% weight on ODF.

33. The process of claim 31, wherein said alkaline hydroxide pulping solution comprises an alkaline hydroxide selected from the group consisting of sodium hydroxide, potassium hydroxide, ammonium hydroxide, calcium hydroxide and combinations thereof.

34. The process of claim 27, wherein the pH is reduced in step (c) to a pH ranging from about 1 to about 3.

35. The process of claim 27, wherein said treating of the nonwood fiber source material with an acid solution occurs at a temperature ranging from about 50° C. to about 70° C. and for a time ranging from about 20 minutes to about 30 minutes.

36. The process of claim 27, wherein the acid solution comprises an acid selected from the group consisting of a mineral acid, an organic acid and combinations thereof.

37. The process of claim 36, wherein the acid is selected from the group consisting of sulfuric acid, nitric acid, phosphoric acid, acetic acid and combinations thereof.

38. The process of claim 27, wherein the acid solution further comprises a chelating agent.

39. The process of claim 27, wherein further comprising adjusting the nonwood fiber source material to a consistency of at least about 35% after the step of reducing the pH of the nonwood fiber source material to an acidic pH with an acid solution, and then diluting the nonwood fiber source material to a lower consistency with or without washing the nonwood fiber source material prior to the step of treating the nonwood fiber source material having an acidic pH with ozone.

40. The process of claim 27, wherein the consistency of the nonwood fiber source material ranges from about 3% to about 10%.

41. The process of claim 27, wherein the ozone is present in a dosage ranging from about 0.4% weight to about 1% weight on ODF.

42. The process of claim 27, wherein said treating the nonwood fiber source material having an acidic pH with ozone produces a pulp having a Kappa number of at least as low as 5.

43. The process of claim 27, wherein said treating the nonwood fiber source material with a bleaching solution occurs at a temperature of at least about 100° C. and said bleaching solution comprises an alkaline peroxide bleaching solution.

44. The process of claim 43, wherein the temperature is a temperature ranging from about 105° C. to about 110° C.

45. The process of claim 43, wherein said alkaline peroxide bleaching solution comprises sodium hydroxide, hydrogen peroxide, magnesium sulfate, sodium silicate and a chelant.

46. The process of claim 27, wherein the bleaching solution comprises a chlorine dioxide or other chlorine-based bleaching solution.

47. The process of claim 27, further comprising the step of cleaning the nonwood fiber source material with at least one filtering screen after the step of treating the nonwood fiber source material having an acidic pH with ozone and before the step of treating the nonwood fiber source material with a bleaching solution.

48. The process of claim 27, wherein the papermaking pulp has a brightness level of at least 80% ISO.

49. The process of claim 27, wherein the papermaking pulp has a freeness level of at least 550 mL CSF or greater.

50. The process of claim 27, wherein the papermaking pulp has a Kappa value ranging downwardly from about 5 to about 1.

51. A process for producing a pulp suitable for making paper from a nonwood fiber source material, the process comprising the sequential steps of:

(a) providing a nonwood fiber source material;

(b) extracting the nonwood fiber source material with an alkaline hydroxide pulping solution for about 30 to about 60 minutes at a pressure ranging from about atmospheric pressure to about 30 psig and at a temperature ranging from about 80° C. to about 120° C., wherein alkaline hydroxide in the alkaline hydroxide pulping solution is present in a dosage of ranging from about 10% weight to about 30% weight on ODF;

(c) reducing the pH of the nonwood fiber source material to a pH ranging from about 1 to about 3 with an acid solution at a temperature ranging from about 50° C. to about 70° C. and for a time ranging from about 20 minutes to about 30 minutes;

(d) dewatering the nonwood fiber source material to a consistency of at least about 35% and then diluting the nonwood fiber source material to a lower consistency ranging from about 1% to about 10%;

(e) treating the nonwood fiber source material having an acidic pH with ozone at about ambient temperature for about 5 to about 15 minutes, wherein the ozone is present in a dosage ranging from about 0.4% weight to about 1% weight on ODF;

(f) cleaning the nonwood fiber source material with at least one filtering screen; and (g) treating the nonwood fiber source material with a bleaching solution comprising a bleaching agent different from the ozone of step (e) at a temperature ranging from about 70° C. to about 110° C. to form a papermaking pulp having a Kappa value of at least as low as 5, a freeness level of at least 400 mL CSF or greater and a brightness level of at least 80% ISO.

52. The method of claim 51, wherein the nonwood fiber source material is selected from a group comprising corn stover, kenaf, industrial hemp, sisal, rye grass straw, wheat straw, rice straw, bagasse, hesperaloe, flax straw and combinations thereof.

53. The method of claim 52, wherein the nonwood fiber source material is corn stover, wheat straw, bagasse or combinations thereof.

54. The process of claim 51, wherein said alkaline hydroxide solution comprises an alkaline hydroxide selected from the group consisting of sodium hydroxide, potassium hydroxide, ammonium hydroxide, calcium hydroxide and combinations thereof.

55. The process of claim, 51, wherein the acid solution comprises an acid selected from the group consisting of a mineral acid, an organic acid and combinations thereof.

56. The process of claim 55, wherein the acid is selected from the group consisting of sulfuric acid, nitric acid, phosphoric acid, acetic acid and combinations thereof.

57. The process of claim 51, wherein the acid solution further comprises a chelating agent.

58. The process of claim 51, further comprising adjusting the nonwood fiber source material to a consistency of at least about 35% after the step of reducing the pH of the nonwood fiber source material to an acidic pH with an acid solution, and then diluting the nonwood fiber source material to a lower consistency with or without washing the nonwood fiber source material prior to the step of treating the nonwood fiber source material having an acidic pH with ozone.

59. The process of claim 51, wherein the consistency of the nonwood fiber source material ranges from about 3% to about 10%.

60. The process of claim, 51, wherein said treating the nonwood fiber source material having an acidic pH with ozone produces a pulp having a Kappa number of at least as low as 5.

61. The process of claim 51, wherein said treating the nonwood fiber source material with a bleaching solution occurs at a temperature of at least about 100° C. and said bleaching solution comprises an alkaline peroxide bleaching solution.

62. The process of claim 61, wherein the temperature is a temperature ranging from about 105° C. to about 110° C.

63. The process of claim 61, wherein said alkaline peroxide bleaching solution comprises sodium hydroxide, hydrogen peroxide, magnesium sulfate, sodium silicate and a chelant.

64. The process of claim 51, wherein the bleaching solution comprises a chlorine dioxide or other chlorine-based bleaching solution.

* * * * *

UNITED STATES PATENT AND TRADEMARK OFFICE

CERTIFICATE OF CORRECTION

PATENT NO. : 6,302,997 B1 
DATED : October 16, 2001
INVENTOR(S) : Robert W. Hurter et al.

It is certified that error appears in the above-identified patent and that said Letters Patent is hereby corrected as shown below:

Drawings,
Delete Figures 1-5, and substitute therefor figures 1-5, reflecting the following changes:

Figure 1,
Please add the heading -- FIBER PREPARATION --.
In the top, left-hand corner, please change "i.x." to -- i.e., --.
At the top, right-hand corner of the schematic, please change "balance retaining an effluent treatment" to -- balance remaining to effluent treatment --.
On the right-hand side of the drawing adjacent to water tank 32, please change "screen" to -- screw-- in two places.
For hydrapulpers 14 and 16, please change the "/" beside the numbers 1 and 2, respectively, to -- # --.

Figure 2,
At the left of the drawing, adjacent to horizontal tube digester 40, please change "stream" to -- steam --.
For horizontal tube digester 40, please change "(r)" to -- (E) --.

Figure 3,
To the left of digester dewatering screw 56, please change "preperation" to -- preparation--.
To the left of horizontal tube digester 58, please change "stream" to -- steam --.

Figure 4,
Please change the direction of the arrow at the bottom left of the drawing between thickener filtrate tank 92 and pump 94 from a downward pointing arrow to an upward pointing arrow.

UNITED STATES PATENT AND TRADEMARK OFFICE

CERTIFICATE OF CORRECTION

PATENT NO. : 6,302,997 B1 
DATED : October 16, 2001
INVENTOR(S) : Robert W. Hurter et al.

It is certified that error appears in the above-identified patent and that said Letters Patent is hereby corrected as shown below:

Figure 5,
In the heading, please change "(E)" to -- (B) --.
In the top arrow extending to the right from filtrate tank 106, please change "treatment" to -- recovery --.

Signed and Sealed this

Seventh Day of January, 2003

JAMES E. ROGAN
*Director of the United States Patent and Trademark Office*